US011920223B2

(12) United States Patent
Kaner et al.

(10) Patent No.: US 11,920,223 B2
(45) Date of Patent: Mar. 5, 2024

(54) TUNGSTEN TETRABORIDE COMPOSITE MATRIX AND USES THEREOF

(71) Applicants: The Regents of the University of California, Oakland, CA (US); SuperMetalix, Inc., Los Angeles, CA (US)

(72) Inventors: Richard B. Kaner, Pacific Palisades, CA (US); Christopher L. Turner, Lancaster, CA (US); Madapusi K. Keshavan, Oceanside, CA (US); Jack Kavanaugh, Los Angeles, CA (US)

(73) Assignees: The Regents of the University of California, Oakland, CA (US); SuperMetalix, Inc., Los Angeles, CA (US)

( * ) Notice: Subject to any disclaimer, the term of this patent is extended or adjusted under 35 U.S.C. 154(b) by 0 days.

(21) Appl. No.: 18/082,378

(22) Filed: Dec. 15, 2022

(65) Prior Publication Data

US 2023/0123864 A1 Apr. 20, 2023

Related U.S. Application Data

(63) Continuation of application No. 17/526,726, filed on Nov. 15, 2021, now abandoned, which is a (Continued)

(51) Int. Cl.
*C22C 29/14* (2006.01)
*B24D 18/00* (2006.01)
(Continued)

(52) U.S. Cl.
CPC ..... *C22C 29/14* (2013.01); *B24D 18/0009* (2013.01); *C22C 1/051* (2013.01);
(Continued)

(58) Field of Classification Search
CPC ..... C22C 29/14; C22C 1/051; C22C 1/1084; C22C 29/08; C22C 32/0005; C22C 33/0292; B24D 18/0009
See application file for complete search history.

(56) References Cited

U.S. PATENT DOCUMENTS 3,525,610 A 8/1970 Meadows
3,647,576 A 3/1972 Yamamura et al.
(Continued)

FOREIGN PATENT DOCUMENTS

CN 1997475 A 7/2007
CN 105817619 A 8/2016
(Continued)

OTHER PUBLICATIONS

Mohammadi et al., "Tungsten tetraboride, an inexpensive superhad material," PNAS, 108(27): pp. 10958-10962 (2011). [Cited in International Search Report in International Patent Application No. PCT/US18/16911, dated Apr. 24, 2018].
(Continued)

*Primary Examiner* — Ricardo D Morales
(74) *Attorney, Agent, or Firm* — Venable LLP; Henry J. Daley

(57) ABSTRACT

Disclosed herein, in certain embodiments, are composite materials, methods, tools and abrasive materials comprising a tungsten-based metal composition, a tungsten carbide, and an alloy. In some cases, the composite materials or matrix are resistant to oxidation.

20 Claims, 1 Drawing Sheet

Related U.S. Application Data continuation of application No. 15/888,826, filed on Feb. 5, 2018, now Pat. No. 11,174,538.

(60) Provisional application No. 62/455,340, filed on Feb. 6, 2017.

(51) Int. Cl.

| | |
|---|---|
| ***C22C 1/051*** | (2023.01) |
| ***C22C 29/08*** | (2006.01) |
| ***C22C 1/10*** | (2023.01) |
| ***C22C 32/00*** | (2006.01) |
| ***C22C 33/02*** | (2006.01) |

(52) U.S. Cl.

CPC ..... *C22C 1/1084* (2013.01); *C22C 29/08* (2013.01); *C22C 32/0005* (2013.01); *C22C 33/0292* (2013.01)

(56) References Cited

U.S. PATENT DOCUMENTS

| | | | | |
|---|---|---|---|---|
| 4,923,512 | A | 5/1990 | Timm et al. | |
| 5,238,481 | A | 8/1993 | Kenichi et al. | |
| 5,476,531 | A * | 12/1995 | Timm | C22C 29/08 75/240 |
| 8,535,604 | B1 | 9/2013 | Baker et al. | |
| 2009/0186211 | A1 | 7/2009 | Chun et al. | |
| 2011/0262295 | A1 | 10/2011 | Voronov et al. | |
| 2014/0041313 | A1 * | 2/2014 | Kaner | C23C 30/005 51/309 |
| 2015/0143953 | A1 | 5/2015 | Chen | |

FOREIGN PATENT DOCUMENTS

| | | | | |
|---|---|---|---|---|
| JP | 2008-201080 | A | 9/2008 | |
| KR | 10-1215656 | B1 | 1/2013 | |
| WO | 2006-001791 | A1 | 1/2006 | |
| WO | WO-2006001791 | A1 * | 1/2006 | B22F 1/02 |

OTHER PUBLICATIONS

Mohammadi et al. "Enhancing the Hardness of Superhard Transition-Metal Borides: Molybdenum-Doped Tungsten Tetraboride", Chemistry of Materials, Dec. 21, 2015, vol. 28, No. 2, pp. 632-637, XP055607500.

* cited by examiner

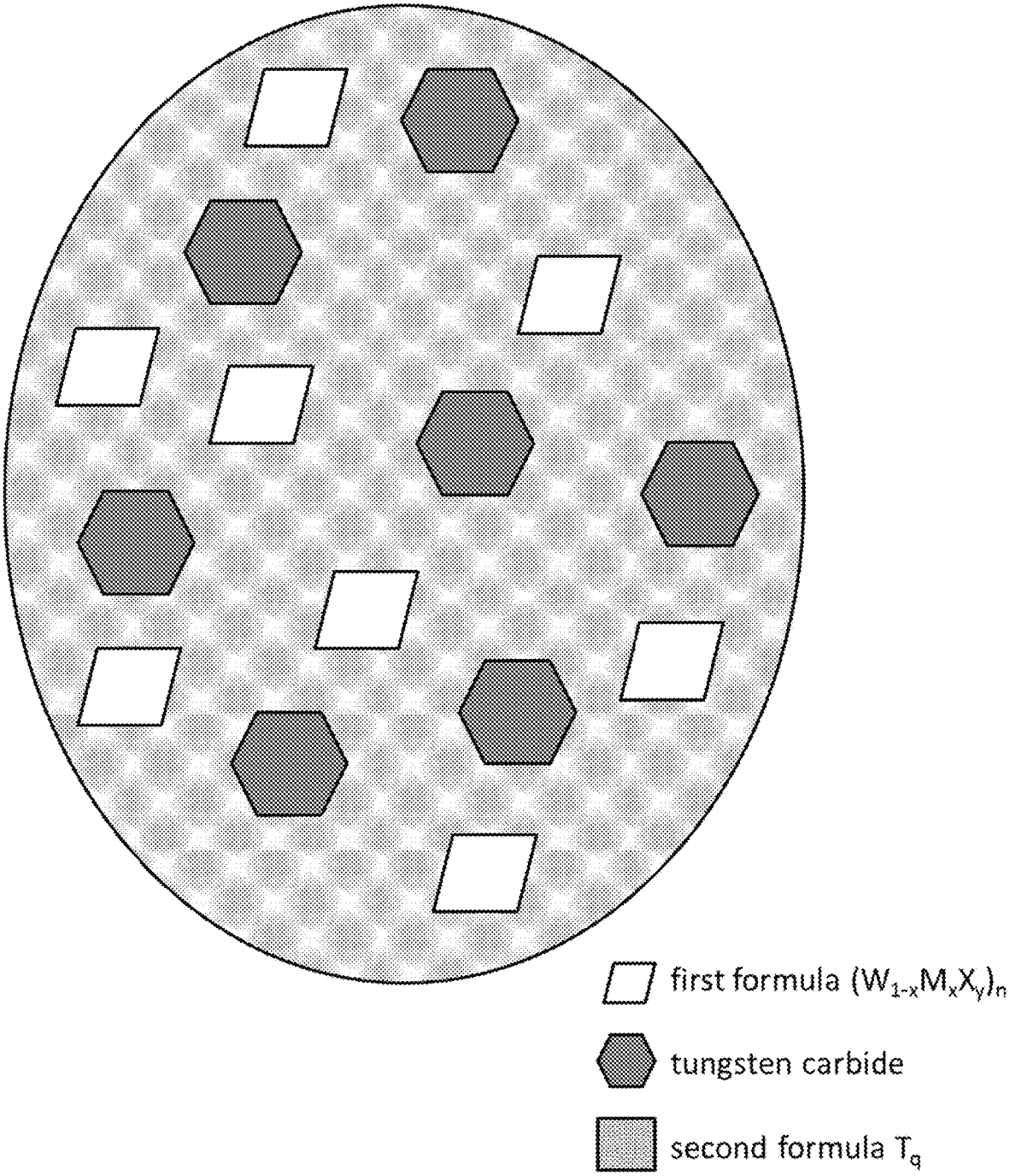
first formula $(W_{1-x}M_xX_y)_n$
tungsten carbide
second formula $T_q$

TUNGSTEN TETRABORIDE COMPOSITE MATRIX AND USES THEREOF

CROSS-REFERENCE OF RELATED APPLICATION

This application is a continuation of U.S. application Ser. No. 17/526,726 filed Nov. 15, 2021, which is a continuation of U.S. application Ser. No. 15/888,826, filed Feb. 5, 2018, now U.S. Pat. No. 11,174,538, issued Nov. 16, 2021, which claims priority to U.S. Provisional Application No. 62/455,340 filed Feb. 6, 2017, the entire contents of which are hereby incorporated by reference.

BACKGROUND OF THE INVENTION

In many manufacturing processes, materials must be cut, formed, or drilled and their surfaces protected with wear-resistant coatings. Diamond has traditionally been the material of choice for these applications, due to its superior mechanical properties, e.g. hardness >70 GPa. However, diamond is rare in nature and difficult to synthesize artificially due to the need for a combination of high temperature and high pressure conditions. Industrial applications of diamond are thus generally limited by cost. Moreover, diamond is not a good option for high-speed cutting of ferrous alloys due to its graphitization on the material's surface and formation of brittle carbides, which leads to poor cutting performance.

SUMMARY OF THE INVENTION

Disclosed herein, in certain embodiments, are composite materials, methods, tools and abrasive materials comprising a tungsten-based metal composition, a tungsten carbide, and an alloy. In some instances, the tungsten-based metal composition includes a transition metal element and an element selected from boron (B), silicon (Si) or beryllium (Be). In some cases, the alloy comprises, for example, a Group 4, 5, 6, 7, 8, 9, 10, 11, 12, 13, or 14 element in the Periodic Table of Elements.

In some embodiments, described herein, is a composite matrix comprising:

a) a first formula $(W_{1-x}M_xX_y)_n$ wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(W_{0.99\text{-}1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in a Periodic Table of Elements; and q is from 0.01 to 0.99; and wherein p, q, and n have a sum of 1.

In some embodiments, described herein, is a composite matrix comprising:

a) a tungsten tetraboride of formula $(WB_4)_n$, wherein n is from 0.01 to 0.99;

b) a tungsten carbide of formula $(WC_{0.99\text{-}1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in a Periodic Table of Elements; and q is from 0.01 to 0.99; and wherein p, q, and n have a sum of 1.

In some embodiments, described herein, is a method of preparing a densified composite matrix, comprising:

a) blending together a first composition having a formula $(W_{1-x}M_xX_y)_n$, a tungsten carbide composition of formula $(WC_{0.99\text{-}1.05})_p$, and a second composition of formula $T_q$ for a time sufficient to produce a powder mixture;

wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

T is an alloy comprising at least one Group 4, 5, 6, 7, 8, 9, 10, 11, 12, 13, or 14 element in a Periodic Table of Elements;

x is from 0.001 to 0.999;

y is at least 4.0;

p, q, and n are each independently from 0.01 to 0.99; and p, q, and n have a sum of 1;

b) pressing the powder mixture under a pressure sufficient to generate a pellet; and c) sintering the pellet at a temperature sufficient to produce a densified composite matrix.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

FIG. 1 illustrates a cartoon representation of a composite matrix described herein.

DETAILED DESCRIPTION OF THE INVENTION

Wear and tear are part of the normal use of tools and machines. There are different types of wear mechanisms, including, for example, abrasion wear, adhesion wear or attrition wear, diffusion wear, fatigue wear, edge chipping (or premature wear) and oxidation wear (or corrosive wear). Abrasion wear occurs when the hard particle on debris such as chips passes over or abrades the surface of a cutting tool. Adhesion wear or attrition wear occurs when debris remove microscopic fragments from a tool. Diffusion wear occurs when atoms in a crystal lattice move from a region of high concentration to a region of low concentration and the move weakens the surface structure of a tool. Fatigue wear occurs at a microscopic level when two surfaces slide in contact with each other under high pressure, generating surface cracks. Edge chipping or premature wear occurs as small breaking away of materials from the surface of a tool. Oxidation wear or corrosive wear occurs as a result of a chemical reaction between the surface of a tool and oxygen.

In some embodiments, described herein include composite matrix materials that, when applied to a tool or abrasive material, reduce the rate of oxidation wear of the tool or abrasive material, or inhibits oxidation wear of the tool or abrasive material. In some instances, also described herein include methods of manufacturing of the composite matrix, and tools and abrasive materials for use with the composite matrix.

Disclosed herein, in certain embodiments, are composite materials, methods, tools and abrasive materials comprising a tungsten-based metal composition, a tungsten carbide, and an alloy. In some instances, the tungsten-based metal composition includes a transition metal element and an element selected from boron (B), silicon (Si) or beryllium (Be). In some cases, the alloy comprises, for example, a Group 4, 5, 6, 7, 8, 9, 10, 11, 12, 13, or 14 element in the Periodic Table of Elements.

In some embodiments, described herein, is a composite matrix which comprises:

a) a first formula $(W_{1-x}M_xX_y)_n$ wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $T_q$:

wherein:

T is an alloy comprising at least one Group 4, 5, 6, 7, 8, 9, 10, 11, 12, 13, or 14 element in a Periodic Table of Elements; and q is from 0.01 to 0.99; and wherein the sum of p, q, and n is 1.

In some embodiments, X is B. In some embodiments, M is one of Re, Ta, Mn, Cr, Ta and Mn, or Ta and Cr. In some embodiments, M is one of Ta, Mn, Cr, Ta and Mn, or Ta and Cr. In some embodiments, y is 4. In some embodiments, x is 0.001 to 0.6. In some embodiments, x is 0.001 to 0.4. In some embodiments, X is B, M is Re, and x is at least 0.001 and less than 0.05. In some embodiments, x is about 0.01. In some embodiments, X is B, M is Ta, and x is at least 0.001 and less than 0.05. In some embodiments, x is about 0.02. In some embodiments, X is B, M is Mn, and x is at least 0.001 and less than 0.4. In some embodiments, X is B, M is Cr, and x is at least 0.001 and less than 0.6. In some embodiments, T is an alloy comprising at least one Group 8, 9, 10, 11, 12, 13 or 14 element in the Periodic Table of Elements. In some embodiments, T is an alloy comprising two or more, three or more, four or more, five or more, or six or more Group 4, 5, 6, 7, 8, 9, 10, 11, 12, 13, or 14 elements in the Periodic Table of Elements. In some embodiments, T is an alloy comprising at least one element selected from Cu, Ni, Co, Fe, Si, Al and Ti. In some embodiments, T is an alloy comprising at least one element selected from Co, Fe and Ni. In some embodiments, T is an alloy comprising Co. In some embodiments, T is an alloy comprising Fe. In some embodiments, T is an alloy comprising Ni. In some embodiments, p is from 0.7 to 0.9. In some embodiments, p is about 0.7, 0.75, 0.8, 0.85, 0.9 or 0.95. In some embodiments, p is from 0.2 to 0.3. In some embodiments, q is from 0.01 to 0.4. In some embodiments, q is from 0.1 to 0.3. In some embodiments, q is about 0.1, 0.15, 0.2, 0.25, 0.3, 0.35 or 0.4. In some embodiments, q is from 0.7 to 0.8. In some embodiments, n is from 0.01 to 0.5. In some embodiments, n is about 0.1, 0.15, 0.2, 0.25, 0.3, 0.35, 0.4, 0.45 or 0.5. In some embodiments, n is about 0.25. In some embodiments, p, q and n are weight percentage ranges. In some embodiments, the composite matrix forms a solid solution. In some embodiments, the composite matrix is resistant to oxidation. In some embodiments, the composite matrix is a densified composite matrix.

In some embodiments, described herein, is a composite matrix comprising: (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some embodiments, T is an alloy comprising at least one Group 8, 9, 10, 11, 12, 13 or 14 element in the Periodic Table of Elements. In some embodiments, T is an alloy comprising two or more, three or more, four or more, five or more, or six or more Group 4, 5, 6, 7, 8, 9, 10, 11, 12, 13, or 14 elements in the Periodic Table of Elements. In some embodiments, T is an alloy comprising at least one element selected from Cu, Ni, Co, Fe, Si, Al and Ti. In some embodiments, T is an alloy comprising at least one element selected from Co, Fe or Ni. In some embodiments, T is an alloy comprising Co. In some embodiments, T is an alloy comprising Fe. In some embodiments, T is an alloy comprising Ni. In some embodiments, p is from 0.7 to 0.9. In some embodiments, p is about 0.7, 0.75, 0.8, 0.85, 0.9 or 0.95. In some embodiments, p is from 0.2 to 0.3. In some embodiments, q is from 0.01 to 0.4. In some embodiments, q is from 0.1 to 0.3. In some embodiments, q is about 0.1, 0.15, 0.2, 0.25, 0.3, 0.35 or 0.4. In some embodiments, q is from 0.7 to 0.8. In some embodiments, n is from 0.01 to 0.5. In some embodiments, n is about 0.1, 0.15, 0.2, 0.25, 0.3, 0.35, 0.4, 0.45 or 0.5. In some embodiments, n is about 0.25. In some embodiments, p, q and n are weight percentage ranges.

In some embodiments, described herein, is a composite matrix which comprises:

a) a first formula $(W_{1-x}M_xX_y)_n$ wherein:

W is tungsten (W);

X is one of boron (B), beryllium (Be), and silicon (Si); M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(WC_{0.99\text{-}1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof, wherein:

X' is one of boron (B), beryllium (Be), and silicon (Si);

M' is at least one of hafnium (Hf), zirconium (Zr), and yttrium (Y);

q is from 0.01 to 0.99; and wherein the sum of q and n is 1; and wherein the second formula encompasses the edges, in part or in whole, of the composition comprising a) and b), acting as a protective coating.

In some embodiments, a composite matrix described herein comprising:

a) a first formula $(W_{1-x}M_xB_4)_n$ wherein:

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999; and n is from 0.01 to 0.99;

b) a tungsten carbide of formula $(WC_{0.99\text{-}1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in a Periodic Table of Elements; and q is from 0.01 to 0.99; and wherein the sum of p, q, and n is 1.

In some embodiments, described herein, is a method of preparing a densified composite matrix, comprising:

a) blending together a first composition having a formula $(W_{1-x}M_xX_y)_n$, a tungsten carbide composition of formula $(WC_{0.99\text{-}1.05})_p$, and a second composition of formula $T_q$ for a time sufficient to produce a powder mixture;

wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

T is an alloy comprising at least one Group 4, 5, 6, 7, 8, 9, 10, 11, 12, 13, or 14 element in the Periodic Table of Elements;

x is from 0.001 to 0.999;

y is at least 4.0;

p, q, and n are each independently from 0.01 to 0.99; and the sum of p, q, and n is 1;

b) pressing the powder mixture under a pressure sufficient to generate a pellet; and c) sintering the pellet at a temperature sufficient to produce a densified composite matrix.

In some embodiments, the pressure is up to 36,000 psi. In some embodiments, the temperature is from 1000° C. to 2000° C. In some embodiments, X is B. In some embodiments, M is one of Re, Ta, Mn, Cr, Ta and Mn, or Ta and Cr. In some embodiments, M is one of Ta, Mn, Cr, Ta and Mn, or Ta and Cr. In some embodiments, y is 4. In some embodiments, x is 0.001 to 0.6. In some embodiments, x is 0.001 to 0.4. In some embodiments, X is B, M is Re, and x is at least 0.001 and less than 0.05. In some embodiments, x is about 0.01. In some embodiments, X is B, M is Ta, and x is at least 0.001 and less than 0.05. In some embodiments, x is about 0.02. In some embodiments, X is B, M is Mn, and x is at least 0.001 and less than 0.4. In some embodiments, X is B, M is Cr, and x is at least 0.001 and less than 0.6. In some embodiments, T is an alloy comprising at least one Group 8, 9, 10, 11, 12, 13 or 14 element in the Periodic Table of Elements. In some embodiments, T is an alloy comprising at least one Group 8, 9, 10, 11, 12, 13 or 14 element in the Periodic Table of Elements. In some embodiments, T is an alloy comprising at least one element selected from Cu, Ni, Co, Fe, Si, Al and Ti. In some embodiments, T is an alloy comprising at least one element selected from Co, Fe and Ni. In some embodiments, T is an alloy comprising Co. In some embodiments, T is an alloy comprising Fe. In some embodiments, T is an alloy comprising Ni. In some embodiments, p is from 0.7 to 0.9. In some embodiments, p is about 0.7, 0.75, 0.8, 0.85, 0.9 or 0.95. In some embodiments, p is from 0.2 to 0.3. In some embodiments, q is from 0.01 to 0.4. In some embodiments, q is from 0.1 to 0.3. In some embodiments, q is about 0.1, 0.15, 0.2, 0.25, 0.3, 0.35 or 0.4. In some embodiments, q is from 0.7 to 0.8. In some embodiments, n is from 0.01 to 0.5. In some embodiments, n is about 0.1, 0.15, 0.2, 0.25, 0.3, 0.35, 0.4, 0.45 or 0.5. In some embodiments, n is about 0.25. In some embodiments, p, q and n are weight percentage ranges.

In some embodiments, described herein, is a tool comprising a surface or body for cutting or abrading, wherein the surface or body comprises a composite matrix comprising:

a) a first formula $(W_{1-x}M_xX_y)_n$ wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

x is from 0.001 to 0.999;

y is at least 4.0; and n is from 0.01 to 0.99;

b) a tungsten carbide of formula $(WC_{0.99\text{-}1.05})_p$, wherein p is from 0.01 to 0.99; and c) a second formula $T_q$:

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, described herein, is a tool comprising a surface or body for cutting or abrading, wherein the surface or body comprises a composite matrix comprising:

a) a first formula $(W_{1-x}M_xX_y)_n$ wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof, wherein:

X' is one of boron (B), beryllium (Be), and silicon (Si);

M' is at least one of hafnium (Hf), zirconium (Zr), and yttrium (Y);

q is from 0.01 to 0.99; and wherein the sum of q and n is 1; and wherein the second formula encompasses the edges, in part or in whole, of the composition comprising a) and b), acting as a protective coating.

Tungsten-Based Composite Matrix

In some embodiments, a composite matrix described herein comprises a tungsten-based first composition, a tungsten carbide, and an alloy. In some instances, the composite matrix is a superhard material. In some instances, the composite matrix comprises a solid solution phase. In additional instances, the composite matrix is resistant to oxidation.

In some embodiments, described herein is a composite matrix which comprises:

a) a first formula $(W_{1-x}M_xX_y)_n$ wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $T_q$:

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, X from the first formula $(W_{1-x}M_xX_y)_n$ is one of B and Si. In some embodiments, X from the first formula $(W_{1-x}M_xX_y)_n$ is one of Be and Si. In some instances, X is boron (B). In other instances, X is silicon (Si). In additional instances, X is beryllium (Be).

In some embodiments, M comprises at least one of Re, Ta, Mn, Cr, Hf, Ta, Zr and Y. In some embodiments, M comprises at least one of Re, Ta, Mn and Cr. Sometimes, M comprises at least one of Ta, Mn and Cr. Other times, M comprises at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al). In some cases, M comprises Ta and an element selected from Ti, V, Cr, Mn, Fe, Co, Ni, Cu, Zn, Zr, Nb, Mo, Ru, Hf, Re, Os, Jr, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Jr, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Jr, Li, Y and Al. In some cases, M comprises Y and an element selected from Ti, V, Cr, Mn, Fe, Co, Ni, Cu, Zn, Ta, Nb, Mo, Ru, Hf, Re, Os, Jr, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M is selected from Ta, Mn, Cr, Ta and Mn, or Ta and Cr. M can be Re. Other times, M is selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li.

In some embodiments, x has a value within the range 0.001 to 0.999, inclusively. In some embodiments, x has a value within the range 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some cases, x is at least about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999; alternatively or in combination, x is no more than about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99.

In some embodiments, y is at least 2, 4, 6, or 12. In some instances, y is at least 2. In some cases, y is at least 4. In some cases, y is at least 6. In some cases y is at least 12. In some cases, y is no more than 2, 4, 6, or 12. In some cases, y is no more than 2. In some cases, y is no more than 4. In some cases, y is no more than 6. In some cases, y is no more than 12.

In some embodiments, X is B and M comprises at least one of Re, Ta, Mn, Cr, Hf, Ta, Zr and Y. In some embodiments, X is B and M comprises at least one of Re, Ta, Mn and Cr. Sometimes, X is B and M comprises at least one of Ta, Mn and Cr. Other times, X is B and M comprises at least one of Hf, Zr, and Y. In some instances, X is B and M comprises at least Re. In some instances, X is B and M comprises at least Ta. In some instances, X is B and M comprises at least Mn. In some instances, X is B and M comprises at least Cr. In some cases, X is B and M comprises at least Hf. In some cases, X is B and M comprises at least Zr. In some cases, X is B and M comprises at least Y. In some cases, X is B and M comprises at least Ti. In some cases, X is B and M comprises at least V. In some cases, X is B and M comprises at least Co. In some cases, X is B and M comprises at least Ni. In some cases, X is B and M comprises at least Cu. In some cases, X is B and M comprises at least Zn. In some cases, X is B and M comprises at least Nb. In some cases, X is B and M comprises at least Mo. In some cases, X is B and M comprises at least Ru. In some cases, X is B and M comprises at least Os. In some cases, X is B and M comprises at least Ir. In some cases, X is B and M comprises at least Li.

In some instances, X is B and M comprises two or more elements selected from Ti, V, Cr, Mn, Fe, Co, Ni, Cu, Zn, Zr, Nb, Mo, Ru, Hf, Ta, Re, Os, Jr, Li, Y and Al. In some cases, X is B and M comprises Ta and an element selected from Ti, V, Cr, Mn, Fe, Co, Ni, Cu, Zn, Zr, Nb, Mo, Ru, Hf, Re, Os, Jr, Li, Y and Al. In some cases, X is B and M comprises Ta and an element selected from Mn or Cr. In some cases, X is B and M comprises Hf and an element selected from Ti, V, Cr, Mn, Fe, Co, Ni, Cu, Zn, Zr, Nb, Mo, Ru, Re, Os, Jr, Li, Ta, Y and Al. In some cases, X is B and M comprises Zr and an element selected from Ti, V, Cr, Mn, Fe, Co, Ni, Cu, Zn, Ta, Nb, Mo, Ru, Hf, Re, Os, Jr, Li, Y and Al. In some cases, X is B and M comprises Y and an element selected from Ti, V, Cr, Mn, Fe, Co, Ni, Cu, Zn, Ta, Nb, Mo, Ru, Hf, Re, Os, Jr, Li, Zr and Al.

In some embodiments, X is B and M is selected from Re, Ta, Mn, Cr, Hf, Ta, Zr, Y, Ta and Mn, or Ta and Cr. In some embodiments, X is B and M is selected from Re, Ta, Mn, Cr, Ta and Mn, or Ta and Cr. Sometimes, X is B and M is selected from Ta, Mn, Cr, Ta and Mn, or Ta and Cr. M can be Re. Other times, X is B and M is selected from Hf, Zr, and Y. In some cases, X is B and M is Ta. In some cases, X is B and M is Mn. In some cases, X is B and M is Cr. In some cases, X is B and M is Ta and Mn. In some cases, X is B and M is Ta and Cr. In some cases, X is B and M is Hf. In some cases, X is B and M is Zr. In some cases, X is B and M is Y. In some cases, X is B and M is Ti. In some cases, X is B and M is V. In some cases, X is B and M is Co. In some cases, X is B and M is Ni. In some cases, X is B and M is Cu. In some cases, X is B and M is Zn. In some cases, X is B and M is Nb. In some cases, X is B and M is Mo. In some cases, X is B and M is Ru. In some cases, X is B and M is Os. In some cases, X is B and M is Ir. In some cases, X is B and M is Li.

In some embodiments, X is B, M is Re, and x is at least 0.001 and less than 0.6. In some embodiments, X is B, M is Re, and x is at least 0.001 and less than 0.5. In some embodiments, X is B, M is Re, and x is at least 0.001 and less than 0.4. In some embodiments, X is B, M is Re, and x is at least 0.001 and less than 0.3. In some embodiments, X is B, M is Re, and x is at least 0.001 and less than 0.2. In some embodiments, X is B, M is Re, and x is at least 0.001 and less than 0.1.

In some embodiments, X is B, M is Ta, and x is at least 0.001 and less than 0.6. In some embodiments, X is B, M is Ta, and x is at least 0.001 and less than 0.5. In some embodiments, X is B, M is Ta, and x is at least 0.001 and less than 0.4. In some embodiments, X is B, M is Ta, and x is at least 0.001 and less than 0.3. In some embodiments, X is B, M is Ta, and x is at least 0.001 and less than 0.2. In some embodiments, X is B, M is Ta, and x is at least 0.001 and less than 0.1. In some embodiments, X is B, M is Ta, and x is at least 0.001 and less than 0.05. In some embodiments, X is B, M is Ta, and x is about 0.02. In some embodiments, X is B, M is Ta, and x is about 0.04.

In some embodiments, X is B, M is Mn, and x is at least 0.001 and less than 0.6. In some embodiments, X is B, M is Mn, and x is at least 0.001 and less than 0.5. In some embodiments, X is B, M is Mn, and x is at least 0.001 and less than 0.4. In some embodiments, X is B, M is Mn, and x is at least 0.001 and less than 0.3. In some embodiments, X is B, M is Mn, and x is at least 0.001 and less than 0.2. In some embodiments, X is B, M is Mn, and x is at least 0.001 and less than 0.1. In some embodiments, X is B, M is Mn, and x is at least 0.001 and less than 0.05.

In some embodiments, X is B, M is Cr, and x is at least 0.001 and less than 0.6. In some embodiments, X is B, M is Cr, and x is at least 0.001 and less than 0.5. In some embodiments, X is B, M is Cr, and x is at least 0.001 and less than 0.4. In some embodiments, X is B, M is Cr, and x is at least 0.001 and less than 0.3. In some embodiments, X is B, M is Cr, and x is at least 0.001 and less than 0.2. In some embodiments, X is B, M is Cr, and x is at least 0.001 and less than 0.1. In some embodiments, X is B, M is Cr, and x is at least 0.001 and less than 0.05.

In some embodiments, X is B and M comprises Ta and Mn. In some embodiments, X is B and M is Ta and Mn. In some embodiments, X is B, M comprises Ta and Mn, and x is at least 0.001 and less than 0.6. In some instances, a composite matrix comprises $W_{0.94}Ta_{0.02}Mn_{0.04}B_y$, wherein y is at least 4. In some instances, a composite matrix comprises $W_{0.94}Ta_{0.02}Mn_{0.04}B_4$.

In some instances, X is B and M comprises Ta and Cr. In some instances, X is B and M is Ta and Cr. In some instances, X is B, M comprises Ta and Cr, and x is at least 0.001 and less than 0.6. In some instances, a composite matrix comprises $W_{0.93}Ta_{0.02}Cr_{0.05}B_y$, wherein y is at least 4. In some instances, a composite matrix comprises $W_{0.93}Ta_{0.02}Cr_{0.05}B_4$.

In some embodiments, a composite matrix described herein comprises $WB_4$.

In some instances, n is about 0.01, 0.05, 0.1, 0.15, 0.2, 0.25, 0.3, 0.35, 0.4, 0.45 or 0.5. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5. In some instances, n is at least about 0.01, 0.05, 0.1, 0.15, 0.2, 0.25, 0.3, 0.35, 0.4, 0.45 or 0.5; alternatively or in combination, n is no more than about 0.01, 0.05, 0.1, 0.15, 0.2, 0.25, 0.3, 0.35, 0.4, 0.45 or 0.5.

In some embodiments, the tungsten carbide of formula $(WC_{0.99\text{-}1.05})_p$ comprises $WC_{0.99}$, $WC_1$, $WC_{1.01}$, $WC_{1.02}$, $WC_{1.03}$, $WC_{1.04}$ or $WC_{1.05}$. In some embodiments, a tungsten carbide described herein comprises a tungsten carbide of formula $(WC_{0.99})_p$, wherein p is from 0.01 to 0.99. In some embodiments, a tungsten carbide described herein comprises a tungsten carbide of formula $(WC_1)_p$, wherein p is from 0.01 to 0.99. In some embodiments, a tungsten carbide described herein comprises a tungsten carbide of formula $(WC_{1.01})_p$, wherein p is from 0.01 to 0.99. In some embodiments, a tungsten carbide described herein comprises a tungsten carbide of formula $(WC_{1.02})_p$, wherein p is from 0.01 to 0.99. In some embodiments, a tungsten carbide described herein comprises a tungsten carbide of formula $(WC_{1.03})_p$, wherein p is from 0.01 to 0.99. In some embodiments, a tungsten carbide described herein comprises a tungsten carbide of formula $(WC_{1.04})_p$, wherein p is from 0.01 to 0.99. In some embodiments, a tungsten carbide described herein comprises a tungsten carbide of formula $(WC_{1.05})_p$, wherein p is from 0.01 to 0.99.

In some embodiments, p is from 0.01 to 0.99. In some embodiments, p is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, p is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, p is about 0.01. In some cases, p is about 0.05. In some cases, p is about 0.1. In some cases, p is about 0.15. In some cases, p is about 0.2. In some cases, p is about 0.25. In some cases, p is about 0.3. In some cases, p is about 0.35. In some cases, p is about 0.4. In some cases, p is about 0.5. In some cases, p is about 0.6. In some cases, p is about 0.7. In some cases, p is about 0.75. In some cases, p is about 0.8. In some cases, p is about 0.85. In some cases, p is about 0.9. In some cases, p is about 0.95. In some cases, p is about 0.99. In some cases, p is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, p is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

T from the second formula $T_q$ can be an alloy comprising at least one Group 4, 5, 6, 7, 8, 9, 10, 11, 12, 13, or 14 element in the Periodic Table of Elements. Sometimes, T is an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T comprises Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. In some embodiments, the weight percentage of Cu is at least about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %; alternatively or in combination, the weight percentage of Cu is no more than about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %. The weight percentage of Co may be about 10-20 wt. %. In some embodiments, the weight percentage of Co is at least about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %; alternatively or in combination, the weight percentage of Cu is no more than about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %. The weight percentage of Sn may be less than 7 wt. %, may be up to 7 wt. % or may be about 5 wt. %. In some embodiments, the weight percentage of Sn is at least about 1 wt. %, 2 wt. %, 3 wt. %, 4 wt. %, 5 wt. %, 6 wt. %, or about 7 wt. %; alternatively or in combination, the weight percentage of Sn is no more than about 1 wt. %, 2 wt. %, 3 wt. %, 4 wt. %, 5 wt. %, 6 wt. %, or about 7 wt. %. The weight percentage of Ni may be about 5-15 wt. %. In some embodiments, the weight percentage of Ni is at least about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %; alternatively or in combination, the weight percentage of Ni is no more than about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %. The weight percentage of W may be about 15 wt. %.

In some embodiments, q is from 0.01 to 0.99. In some embodiments, q is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, q is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some instances, q is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, q is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some cases, as used herein, p, q and n are weight percentage ranges.

In some embodiments, a composite matrix described herein is resistant to oxidation. In some embodiments, a composite matrix described herein has anti-oxidation property. For example, when the composite matrix is coated on the surface of a tool, the composite matrix reduces the rate of oxidation of the tool in comparison to a tool not coated with the composite matrix. In an alternative example, when the composite matrix is coated on the surface of a tool, the composite matrix prevents oxidation of the tool in comparison to a tool not coated with the composite matrix. In some instances, a tungsten carbide of formula $(WC_{0.99\text{-}1.05})_p$ in the composite matrix inhibits the formation of oxidation or reduces the rate of oxidation. In other instances, a tungsten carbide of formula $(WC_{0.99\text{-}1.05})_p$ in combination with $T_q$ in the composite matrix inhibits the formation of oxidation or reduces the rate of oxidation.

In some embodiments, a composite matrix described herein comprises a solid solution phase. In some embodiments, a composite matrix described herein forms a solid solution. In some instances, the composite matrix in a solid solution phase comprises a tungsten-based compound of a first formula $(W_{1-x}M_xX_y)_n$, a tungsten carbide of formula $(WC_{0.99\text{-}1.05})_p$, and $T_q$. In some instances, the composite matrix in a solid solution phase comprises a tungsten-based compound of a first formula $(W_{1-x}M_xB_4)_n$, a tungsten carbide of formula $(WC_{0.99\text{-}1.05})_p$, and $T_q$. In some instances, the composite matrix in a solid solution phase comprises a tungsten-based compound of a first formula $(WB_4)_n$, a tungsten carbide of formula $(WC_{0.99\text{-}1.05})_p$, and $T_q$.

In some embodiments, a composite matrix described herein has a hardness of about 1 to about 70 GPa. In some instances, a composite matrix described herein has a hardness of about 1 to about 60 GPa, about 1 to about 50 GPa, about 1 to about 40 GPa, about 1 to about 30 GPa, about 5 to about 70 GPa, about 5 to about 60 GPa, about 5 to about 50 GPa, about 5 to about 40 GPa, about 5 to about 30 GPa, 10 to about 70 GPa. In some instances, a composite matrix described herein has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite matrix described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite matrix comprising silicon has a hardness of at least about 10 GPa, 15 GPa, 20 GPa, 25 GPa, 30 GPa, 35 GPa, 40 GPa, 45 GPa, 50 GPa, 55 GPa, or about 60 GPa; alternatively or in combination, the composite matrix comprising silicon has a hardness of no more than about 10 GPa, 15 GPa, 20 GPa, 25 GPa, 30 GPa, 35 GPa, 40 GPa, 45 GPa, 50 GPa, 55 GPa, 60 GPa, or about 70 GPa.

In some embodiments, a composite matrix described herein has a hardness of about 1 GPa, about 2 GPa, about 3 GPa, about 4 GPa, about 5 GPa, about 6 GPa, about 7 GPa, about 8 GPa, about 9 GPa, about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite matrix described herein has a hardness of about 1 GPa or higher. In some embodiments, a composite matrix described herein has a hardness of about 2 GPa or higher. In some embodiments, a composite matrix described herein has a hardness of about 3 GPa or higher. In some embodiments, a composite matrix described herein has a hardness of about 4 GPa or higher. In some embodiments, a composite matrix described herein has a hardness of about 5 GPa or higher. In some embodiments, a composite matrix described herein has a hardness of about 6 GPa or higher. In some embodiments, a composite matrix described herein has a hardness of about 7 GPa or higher. In some embodiments, a composite matrix described herein has a hardness of about 8 GPa or higher. In some embodiments, a composite matrix described herein has a hardness of about 9 GPa or higher. In some embodiments, a composite matrix described herein has a hardness of about 10 GPa or higher. In some embodiments, a composite matrix described herein has a hardness of about 15 GPa or higher. In some embodiments, a composite matrix described herein has a hardness of about 20 GPa or higher. In some embodiments, a composite matrix described herein has a hardness of about 25 GPa or higher. In some embodiments, a composite matrix described herein has a hardness of about 30 GPa or higher. In some embodiments, a composite matrix described herein has a hardness of about 31 GPa or higher. In some embodiments, a composite matrix described herein has a hardness of about 32 GPa or higher. In some embodiments, a composite matrix described herein has a hardness of about 33 GPa or higher. In some embodiments, a composite matrix described herein has a hardness of about 34 GPa or higher. In some embodiments, a composite matrix described herein has a hardness of about 35 GPa or higher. In some embodiments, a composite matrix described herein has a hardness of about 36 GPa or higher. In some embodiments, a composite matrix described herein has a hardness of about 37 GPa or higher. In some embodiments, a composite matrix described herein has a hardness of about 38 GPa or higher. In some embodiments, a composite matrix described herein has a hardness of about 39 GPa or higher. In some embodiments, a composite matrix described herein has a hardness of about 40 GPa or higher. In some embodiments, a composite matrix described herein has a hardness of about 41 GPa or higher. In some embodiments, a composite matrix described herein has a hardness of about 42 GPa or higher. In some embodiments, a composite matrix described herein has a hardness of about 43 GPa or higher. In some embodiments, a composite matrix described herein has a hardness of about 44 GPa or higher. In some embodiments, a composite matrix described herein has a hardness of about 45 GPa or higher. In some embodiments, a composite matrix described herein has a hardness of about 46 GPa or higher. In some embodiments, a composite matrix described herein has a hardness of about 47 GPa or higher. In some embodiments, a composite matrix described herein has a hardness of about 48 GPa or higher. In some embodiments, a composite matrix described herein has a hardness of about 49 GPa or higher. In some embodiments, a composite matrix described herein has a hardness of about 50 GPa or higher. In some embodiments, a composite matrix described herein has a hardness of about 51 GPa or higher. In some embodiments, a composite matrix described herein has a hardness of about 52 GPa or higher. In some embodiments, a composite matrix described herein has a hardness of about 53 GPa or higher. In some embodiments, a composite matrix described herein has a hardness of about 54 GPa or higher. In some embodiments, a composite matrix described herein has a hardness of about 55 GPa or higher. In some embodiments, a composite matrix described herein has a hardness of about 56 GPa or higher. In some embodiments, a composite matrix described herein has a hardness of about 57 GPa or higher. In some embodiments, a composite matrix described herein has a hardness of about 58 GPa or higher. In some embodiments, a composite matrix described herein has a hardness of about 59 GPa or higher. In some embodiments, a composite matrix described herein has a hardness of about 60 GPa or higher.

In some embodiments, a composite matrix described herein has a bulk modulus of about 330 GPa to about 350 GPa.

In some embodiments, a composite matrix described herein has a fracture toughness of about 1 to about 25 MPa $m^{1/2}$. In some instances, a composite matrix described herein has a fracture toughness of about 1 to about 20 MPa $m^{1/2}$, about 1 to about 19 MPa $m^{1/2}$, about 1 to about 18 MPa $m^{1/2}$, about 1 to about 17 MPa $m^{1/2}$, about 1 to about 16 MPa $m^{1/2}$, about 1 to about 15 MPa $m^{1/2}$, about 1 to about 14 MPa $m^{1/2}$, about 1 to about 13 MPa $m^{1/2}$, about 1 to about 12 MPa $m^{1/2}$, about 1 to about 11 MPa $m^{1/2}$, about 1 to about 10 MPa $m^{1/2}$, about 1 to about 5 MPa $m^{1/2}$, about 2 to about 20 MPa $m^{1/2}$, about 3 to about 20 MPa $m^{1/2}$, about 4 to about 20 MPa $m^{1/2}$, about 5 to about 20 MPa $m^{1/2}$, about 5 to about 15 MPa $m^{1/2}$, or about 5 to about 10 MPa $m^{1/2}$.

In some embodiments, a composite matrix described herein has a fracture toughness of about 1 MPa $m^{1/2}$, about 2 MPa $m^{1/2}$, about 3 MPa $m^{1/2}$, about 4 MPa $m^{1/2}$, about 5 MPa $m^{1/2}$, about 6 MPa $m^{1/2}$, about 7 MPa $m^{1/2}$, about 8 MPa $m^{1/2}$, about 9 MPa $m^{1/2}$, about 10 MPa $m^{1/2}$, about 11 MPa $m^{1/2}$, about 12 MPa $m^{1"2}$ Pa, about 13 MPa $m^{1/2}$, about 14 MPa $m^{1/2}$, about 15 MPa $m^{1/2}$, about 16 MPa $m^{1/2}$, about 17 MPa $m^{1/2}$, about 18 MPa $m^{1/2}$, about 19 MPa $m^{1/2}$, about 20 MPa $m^{1/2}$, about 25 MPa $m^{1/2}$, or about 30 MPa $m^{1/2}$.

In some embodiments, a composite matrix described herein has a fracture toughness of at least about 1 MPa $m^{1/2}$, about 2 MPa $m^{1/2}$, about 3 MPa $m^{1/2}$, about 4 MPa $m^{1/2}$, about 5 MPa $m^{1/2}$, about 6 MPa $m^{1/2}$, about 7 MPa $m^{1/2}$, about 8 MPa $m^{1/2}$, about 9 MPa $m^{1/2}$, about 10 MPa $m^{1/2}$, about 11 MPa $m^{1/2}$, about 12 MPa $m^{1/2}$ Pa, about 13 MPa $m^{1/2}$, about 14 MPa $m^{1/2}$, about 15 MPa $m^{1/2}$, about 16 MPa $m^{1/2}$, about 17 MPa $m^{1/2}$, about 18 MPa $m^{1/2}$, about 19 MPa $m^{1/2}$, about 20 MPa $m^{1/2}$, about 25 MPa $m^{1/2}$, or about 30 MPa $m^{1/2}$; alternatively or in combination, the composite matrix has a fracture toughness of no more than about 1 MPa $m^{1/2}$, about 2 MPa $m^{1/2}$, about 3 MPa $m^{1/2}$, about 4 MPa $m^{1/2}$, about 5 MPa $m^{1/2}$, about 6 MPa $m^{1/2}$, about 7 MPa $m^{1/2}$, about 8 MPa $m^{1/2}$, about 9 MPa $m^{1/2}$, about 10 MPa $m^{1/2}$, about 11 MPa $m^{1/2}$, about 12 MPa $m^{1/2}$ Pa, about 13 MPa $m^{1/2}$, about 14 MPa $m^{1/2}$, about 15 MPa $m^{1/2}$, about 16 MPa $m^{1/2}$, about 17 MPa $m^{1/2}$, about 18 MPa $m^{1/2}$, about 19 MPa $m^{1/2}$, about 20 MPa $m^{1/2}$, about 25 MPa $m^{1/2}$, or about 30 MPa $m^{1/2}$.

In some embodiments, a composite matrix described herein has a transverse rupture strength of about 0.1 to about 5.0 GPa. In some instances, a composite matrix described herein has a transverse rupture strength of about 0.1 to about 5.0 GPa, about 0.2 to about 4.9 GPa, about 0.3 to about 4.8 GPa, about 0.4 to about 4.7 GPa, about 0.5 to about 4.6 GPa, about 0.5 to about 4.5 GPa, about 0.6 to about 4.4 GPa, about 0.7 to about 4.3 GPa, about 0.8 to about 4.2 GPa, about 0.9 to about 4.1 GPa, about 0.9 to about 4.0 GPa, about 0.9 to about 3.9 GPa, about 0.9 to about 3.8 GPa, about 0.9 to about 3.7 GPa, about 0.9 to about 3.6 GPa, about 0.5 to about 3.8 GPa, about 0.4 to about 3.3 GPa, about 0.2 to about 3.1 GPa, about 0.9 to about 3.0 GPa, about 0.9 to about 2.9 GPa, about 0.9 to about 2.8 GPa, about 0.9 to about 2.7 GPa, about 0.9 to about 2.6 GPa, about 0.9 to about 2.5 GPa, about 0.9 to about 2.4 GPa, about 0.9 to about 2.3 GPa, about 0.9 to about 2.2 GPa, about 0.9 to about 2.1 GPa, about 0.9 to about 2.0 GPa, about 1.0 to about 1.9 GPa, about 1.1 to about 1.8 GPa, about 1.2 to about 1.7 GPa, about 1.3 to about 1.6 GPa, about 1.0 to about 1.5 GPa, about 0.5 to about 2.0 GPa, about 1.0 to about 3.0 GPa, or about 1.0 to about 2.5 GPa, In some embodiments, a composite matrix described herein has a transverse rupture strength of about 0.1 GPa, about 0.2 GPa, about 0.3 GPa, about 0.4 GPa, about 0.5 GPa, about 0.6 GPa, about 0.7 GPa, about 0.8 GPa, about 0.9 GPa, about 1.0 GPa, about 1.1 GPa, about 1.2 GPa, about 1.3 GPa, about 1.4 GPa, about 1.5 GPa, about 1.6 GPa, about 1.7 GPa, about 1.8 GPa, about 1.9 GPa, about 2.0 GPa, about 2.1 GPa, about 2.2 GPa, about 2.3 GPa, about 2.4 GPa, about 2.5 GPa, about 2.6 GPa, about 2.7 GPa, about 2.8 GPa, about 2.9 GPa, about 3.0 GPa, 3.1 GPa, about 3.2 GPa, about 3.3 GPa, about 3.4 GPa, about 3.5 GPa, about 3.6 GPa, about 3.7 GPa, about 3.8 GPa, about 3.9 GPa, about 4.0 GPa, 4.1 GPa, about 4.2 GPa, about 4.3 GPa, about 4.4 GPa, about 4.5 GPa, about 4.6 GPa, about 4.7 GPa, about 4.8 GPa, about 4.9 GPa, or about 5.0 GPa.

In some embodiments, a composite matrix described herein has a transverse rupture strength of at least about 0.1 GPa, about 0.2 GPa, about 0.3 GPa, about 0.4 GPa, about 0.5 GPa, about 0.6 GPa, about 0.7 GPa, about 0.8 GPa, about 0.9 GPa, about 1.0 GPa, about 1.1 GPa, about 1.2 GPa, about 1.3 GPa, about 1.4 GPa, about 1.5 GPa, about 1.6 GPa, about 1.7 GPa, about 1.8 GPa, about 1.9 GPa, about 2.0 GPa, about 2.1 GPa, about 2.2 GPa, about 2.3 GPa, about 2.4 GPa, about 2.5 GPa, about 2.6 GPa, about 2.7 GPa, about 2.8 GPa, about 2.9 GPa, about 3.0 GPa, 3.1 GPa, about 3.2 GPa, about 3.3 GPa, about 3.4 GPa, about 3.5 GPa, about 3.6 GPa, about 3.7 GPa, about 3.8 GPa, about 3.9 GPa, about 4.0 GPa, 4.1 GPa, about 4.2 GPa, about 4.3 GPa, about 4.4 GPa, about 4.5 GPa, about 4.6 GPa, about 4.7 GPa, about 4.8 GPa, about 4.9 GPa, or about 5.0 GPa; alternatively or in combination, the composite matrix has a transverse rupture strength of no more than about 0.1 GPa, about 0.2 GPa, about 0.3 GPa, about 0.4 GPa, about 0.5 GPa, about 0.6 GPa, about 0.7 GPa, about 0.8 GPa, about 0.9 GPa, about 1.0 GPa, about 1.1 GPa, about 1.2 GPa, about 1.3 GPa, about 1.4 GPa, about 1.5 GPa, about 1.6 GPa, about 1.7 GPa, about 1.8 GPa, about 1.9 GPa, about 2.0 GPa, about 2.1 GPa, about 2.2 GPa, about 2.3 GPa, about 2.4 GPa, about 2.5 GPa, about 2.6 GPa, about 2.7 GPa, about 2.8 GPa, about 2.9 GPa, about 3.0 GPa, 3.1 GPa, about 3.2 GPa, about 3.3 GPa, about 3.4 GPa, about 3.5 GPa, about 3.6 GPa, about 3.7 GPa, about 3.8 GPa, about 3.9 GPa, about 4.0 GPa, 4.1 GPa, about 4.2 GPa, about 4.3 GPa, about 4.4 GPa, about 4.5 GPa, about 4.6 GPa, about 4.7 GPa, about 4.8 GPa, about 4.9 GPa, or about 5.0 GPa.

In some embodiments, a composite matrix described herein has a grain size of about 20 μm or less. In some instances, the composite matrix has a grain size of about 15 μm or less, about 12 μm or less, about 10 μm or less, about 8 μm or less, about 5 μm or less, about 2 μm or less or about 1 μm or less. In some cases, the composite matrix has a grain size of about 15 μm or less. In some cases, the composite matrix has a grain size of about 12 μm or less. In some cases, the composite matrix has a grain size of about 10 μm or less. In some cases, the composite matrix has a grain size of about 9 μm or less. In some cases, the composite matrix has a grain size of about 8 μm or less. In some cases, the composite matrix has a grain size of about 7 μm or less. In some cases, the composite matrix has a grain size of about 6 μm or less. In some cases, the composite matrix has a grain size of about 5 μm or less. In some cases, the composite matrix has a grain size of about 4 μm or less. In some cases, the composite matrix has a grain size of about 3 μm or less. In some cases, the composite matrix has a grain size of about 2 μm or less. In some cases, the composite matrix has a grain size of about 1 μm or less.

In some embodiments, a composite matrix described herein has a grain size of at least about 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, or about 20 μm; alternatively or in combination, the composite matrix has a grain size of no more than about 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, or about 20 μm.

In some instances, the grain size is an averaged grain size. In some cases, a composite matrix described herein has an averaged grain size of about 20 μm or less. In some instances, the composite matrix has an averaged grain size of about 15 μm or less, about 12 μm or less, about 10 μm or less, about 8 μm or less, about 5 μm or less, about 2 μm or less or about 1 μm or less. In some cases, the composite matrix has an averaged grain size of about 15 μm or less. In some cases, the composite matrix has an averaged grain size of about 12 μm or less. In some cases, the composite matrix has an averaged grain size of about 10 μm or less. In some cases, the composite matrix has an averaged grain size of about 9 μm or less. In some cases, the composite matrix has an averaged grain size of about 8 μm or less. In some cases, the composite matrix has an averaged grain size of about 7 μm or less. In some cases, the composite matrix has an averaged grain size of about 6 μm or less. In some cases, the composite matrix has an averaged grain size of about 5 μm or less. In some cases, the composite matrix has an averaged grain size of about 4 μm or less. In some cases, the composite matrix has an averaged grain size of about 3 μm or less. In some cases, the composite matrix has an averaged grain size of about 2 μm or less. In some cases, the composite matrix has an averaged grain size of about 1 μm or less.

In some embodiments, a composite matrix described herein has an averaged grain size of at least about 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, or about 20 μm; alternatively or in combination, the composite matrix has an averaged grain size of no more than about 1 μm, 2 μm, 3 μm, 4 μm, 5 μm, 6 μm, 7 μm, 8 μm, 9 μm, 10 μm, 11 μm, 12 μm, 13 μm, 14 μm, 15 μm, 16 μm, 17 μm, 18 μm, 19 μm, or about 20 μm.

In some embodiments, a composite matrix described herein is a densified composite matrix. In some instances, the densified composite matrix comprises a tungsten-based compound of a first formula $(W_{1-x}M_xX_y)_n$, a tungsten carbide of formula $(WC_{0.99-1.05})_p$, and $T_q$. In some instances, the densified composite matrix comprises a tungsten-based compound of a first formula $(W_{1-x}M_xB_4)_n$, a tungsten carbide of formula $(WC_{0.99-1.05})_p$, and $T_q$. In some instances, the densified composite matrix comprises a tungsten-based compound of a first formula $(WB_4)_n$, a tungsten carbide of formula $(WC_{0.99-1.05})_p$, and $T_q$.

In some embodiments, described herein is a composite matrix which comprises:

d) a first formula $(W_{1-x}M_xX_y)_n$
   wherein:
   W is tungsten (W);
   X is one of boron (B), beryllium (Be), and silicon (Si);
   M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);
   x is from 0.001 to 0.999;
   y is at least 4.0; and
   n is from 0.01 to 0.99;

e) a tungsten carbide of formula $(WC_{0.99-1.05})_p$, wherein p is from 0.01 to 0.99; and f) a second formula $(M'X')_q$, $(M'X'_2)_q$, $(M'X'_4)_q$, $(M'X'_6)_q$, or $(M'X'_{12})_q$, or a combination thereof,
   wherein:
   X' is one of boron (B), beryllium (Be), and silicon (Si);
   M' is at least one of hafnium (Hf), zirconium (Zr), and yttrium (Y);
   q is from 0.01 to 0.99; and
   wherein the sum of q and n is 1; and
   wherein the second formula encompasses the edges, in part or in whole, of the composition comprising a) and b), acting as a protective coating.

In some embodiments, X' is B and M, X, x, y, n, and p are as described above. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, M' is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, M' is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

Composite Matrix—Tungsten Tetraboride $(W_{1-x}M_xB_4)$

In some embodiments, a composite matrix described herein comprising:

a) a first formula $(W_{1-x}M_xB_4)_n$ wherein:

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999; and n is from 0.01 to 0.99;

b) a tungsten carbide of formula $(WC_{0.99-1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, M comprises at least one of Re, Ta, Mn, Cr, Hf, Ta, Zr and Y. In some embodiments, M comprises at least one of Re, Ta, Mn and Cr. Sometimes, M comprises at least one of Ta, Mn and Cr. Other times, M comprises at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al). In some cases, M comprises Ta and an element selected from Ti, V, Cr, Mn, Fe, Co, Ni, Cu, Zn, Zr, Nb, Mo, Ru, Hf, Re, Os, Jr, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Jr, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Jr, Li, Y and Al. In some cases, M comprises Y and an element selected from Ti, V, Cr, Mn, Fe, Co, Ni, Cu, Zn, Ta, Nb, Mo, Ru, Hf, Re, Os, Jr, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M is selected from Ta, Mn, Cr, Ta and Mn, or Ta and Cr. M can be Re. Other times, M is selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li.

In some embodiments, x has a value within the range 0.001 to 0.999, inclusively. In some embodiments, x has a value within the range 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some cases, x is at least about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999; alternatively or in combination, x is no more than about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99. In some cases, x has a value of at least about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999; alternatively or in combination, x has a value of no more than about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999.

In some embodiments, M is Re and x is at least 0.001 and less than 0.6. In some embodiments, M is Re and x is at least 0.001 and less than 0.5. In some embodiments, M is Re and x is at least 0.001 and less than 0.4. In some embodiments, M is Re and x is at least 0.001 and less than 0.3. In some embodiments, M is Re and x is at least 0.001 and less than 0.2. In some embodiments, M is Re and x is at least 0.001 and less than 0.1.

In some embodiments, M is Ta and x is at least 0.001 and less than 0.6. In some embodiments, M is Ta and x is at least 0.001 and less than 0.5. In some embodiments, M is Ta and x is at least 0.001 and less than 0.4. In some embodiments, M is Ta and x is at least 0.001 and less than 0.3. In some embodiments, M is Ta and x is at least 0.001 and less than 0.2. In some embodiments, M is Ta and x is at least 0.001 and less than 0.1. In some embodiments, M is Ta and x is at least 0.001 and less than 0.05. In some embodiments, M is Ta and x is about 0.02. In some embodiments, M is Ta and x is about 0.04.

In some embodiments, M is Mn and x is at least 0.001 and less than 0.6. In some embodiments, M is Mn and x is at least 0.001 and less than 0.5. In some embodiments, M is Mn and x is at least 0.001 and less than 0.4. In some embodiments, M is Mn and x is at least 0.001 and less than 0.3. In some embodiments, M is Mn and x is at least 0.001 and less than 0.2. In some embodiments, M is Mn and x is at least 0.001 and less than 0.1. In some embodiments, M is Mn and x is at least 0.001 and less than 0.05.

In some embodiments, M is Cr, and x is at least 0.001 and less than 0.6. In some embodiments, M is Cr and x is at least 0.001 and less than 0.5. In some embodiments, M is Cr and x is at least 0.001 and less than 0.4. In some embodiments, M is Cr and x is at least 0.001 and less than 0.3. In some embodiments, M is Cr and x is at least 0.001 and less than 0.2. In some embodiments, M is Cr and x is at least 0.001 and less than 0.1. In some embodiments, M is Cr and x is at least 0.001 and less than 0.05.

In some embodiments, M comprises Ta and Mn. In some embodiments, M is Ta and Mn. In some embodiments, M comprises Ta and Mn, and x is at least 0.001 and less than 0.6. In some instances, a composite matrix comprises $W_{0.94}Ta_{0.02}Mn_{0.04}B_4$.

In some instances, M comprises Ta and Cr. In some instances, M is Ta and Cr. In some instances, M comprises Ta and Cr, and x is at least 0.001 and less than 0.6. In some instances, a composite matrix comprises $W_{0.93}Ta_{0.02}Cr_{0.05}B_4$.

In some instances, n is about 0.01, 0.05, 0.1, 0.15, 0.2, 0.25, 0.3, 0.35, 0.4, 0.45 or 0.5. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5. In some instances, n is at least about 0.01, 0.05, 0.1, 0.15, 0.2, 0.25, 0.3, 0.35, 0.4, 0.45 or 0.5; alternatively or in combination, n is no more than about 0.01, 0.05, 0.1, 0.15, 0.2, 0.25, 0.3, 0.35, 0.4, 0.45 or 0.5.

In some embodiments, the tungsten carbide of formula $(WC_{0.99\text{-}1.05})_p$ comprises $WC_{0.99}$, $WC_1$, $WC_{1.01}$, $WC_{1.02}$, $WC_{1.03}$, $WC_{1.04}$ or $WC_{1.05}$. In some embodiments, a tungsten carbide described herein comprises a tungsten carbide of formula $(WC_{0.99})_p$, wherein p is from 0.01 to 0.99. In some embodiments, a tungsten carbide described herein comprises a tungsten carbide of formula $(WC_1)_p$, wherein p is from 0.01 to 0.99. In some embodiments, a tungsten carbide described herein comprises a tungsten carbide of formula $(WC_{1.01})_p$, wherein p is from 0.01 to 0.99. In some embodiments, a tungsten carbide described herein comprises a tungsten carbide of formula $(WC_{1.02})_p$, wherein p is from 0.01 to 0.99. In some embodiments, a tungsten carbide described herein comprises a tungsten carbide of formula $(WC_{1.03})_p$, wherein p is from 0.01 to 0.99. In some embodiments, a tungsten carbide described herein comprises a tungsten carbide of formula $(WC_{1.04})_p$, wherein p is from 0.01 to 0.99. In some embodiments, a tungsten carbide described herein comprises a tungsten carbide of formula $(WC_{1.05})_p$, wherein p is from 0.01 to 0.99.

In some embodiments, p is from 0.01 to 0.99. In some embodiments, p is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, p is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, p is about 0.01. In some cases, p is about 0.05. In some cases, p is about 0.1. In some cases, p is about 0.15. In some cases, p is about 0.2. In some cases, p is about 0.25. In some cases, p is about 0.3. In some cases, p is about 0.35. In some cases, p is about 0.4. In some cases, p is about 0.5. In some cases, p is about 0.6. In some cases, p is about 0.7. In some cases, p is about 0.75. In some cases, p is about 0.8. In some cases, p is about 0.85. In some cases, p is about 0.9. In some cases, p is about 0.95. In some cases, p is about 0.99. In some cases, p is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, p is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some cases, T is an alloy comprising at least one Group 4, 5, 6, 7, 8, 9, 10, 11, 12, 13, or 14 element in the Periodic Table of Elements. Sometimes, T is an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T comprises Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. In some embodiments, the weight percentage of Cu is at least about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %; alternatively or in combination, the weight percentage of Cu is no more than about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %. The weight percentage of Co may be about 10-20 wt. %. In some embodiments, the weight percentage of Co is at least about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %; alternatively or in combination, the weight percentage of Cu is no more than about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %. The weight percentage of Sn may be less than 7 wt. %, may be up to 7 wt. % or may be about 5 wt. %. In some embodiments, the weight percentage of Sn is at least about 1 wt. %, 2 wt. %, 3 wt. %, 4 wt. %, 5 wt. %, 6 wt. %, or about 7 wt. %; alternatively or in combination, the weight percentage of Sn is no more than about 1 wt. %, 2 wt. %, 3 wt. %, 4 wt. %, 5 wt. %, 6 wt. %, or about 7 wt. %. The weight percentage of Ni may be about 5-15 wt. %. In some embodiments, the weight percentage of Ni is at least about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %; alternatively or in combination, the weight percentage of Ni is no more than about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %. The weight percentage of W may be about 15 wt. %.

In some embodiments, q is from 0.01 to 0.99. In some embodiments, q is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, q is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some instances, q is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, q is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99-1.05})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Cu_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Ni_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Co_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Fe_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99-1.05})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Si_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Al_q$; wherein q is from 0.01 to 0.99; and wherein the sum of p, q, and n is 1.

In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_1)_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.01})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.02})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.03})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.04})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{1.05})_p$, wherein p is from 0.01 to 0.99; and (c) a second formula $Ti_q$; wherein q is from 0.01 to 0.99; and wherein the sum of p, q, and n is 1.

In some embodiments, described herein is a composite matrix which comprises:

a) a first formula $(W_{1-x}M_xB_4)_n$
   wherein:
   M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);
   x is from 0.001 to 0.999; and
   n is from 0.01 to 0.99;

b) a tungsten carbide of formula $(WC_{0.99\text{-}1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof,
   wherein:
   X' is one of boron (B), beryllium (Be), and silicon (Si);
   M' is at least one of Hf, Zr, and Y;
   q is from 0.01 to 0.99; and
   wherein the sum of p, q, and n is 1; and
   wherein the second formula encompasses the edges, in part or in whole, of the composition comprising a) and b), acting as a protective coating.

In some embodiments M, x, n, and p are as described above. In some embodiments, X' is B. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, M' is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, M' is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$, and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

Composite Matrix—Tungsten Tetraboride ($WB_4$)

In some embodiments, a composite matrix described herein comprising: (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $T_q$; wherein T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, the tungsten carbide of formula $(WC_{0.99\text{-}1.05})_p$ comprises $WC_{0.99}$, $WC_1$, $WC_{1.01}$, $WC_{1.02}$, $WC_{1.03}$, $WC_{1.04}$ or $WC_{1.05}$. In some embodiments, a tungsten carbide described herein comprises a tungsten carbide of formula $(WC_{0.99})_p$, wherein p is from 0.01 to 0.99. In some embodiments, a tungsten carbide described herein comprises a tungsten carbide of formula $(WC_1)_p$, wherein p is from 0.01 to 0.99. In some embodiments, a tungsten carbide described herein comprises a tungsten carbide of formula $(WC_{1.01})_p$, wherein p is from 0.01 to 0.99. In some embodiments, a tungsten carbide described herein comprises a tungsten carbide of formula $(WC_{1.02})_p$, wherein p is from 0.01 to 0.99. In some embodiments, a tungsten carbide described herein comprises a tungsten carbide of formula $(WC_{1.03})_p$, wherein p is from 0.01 to 0.99. In some embodiments, a tungsten carbide described herein comprises a tungsten carbide of formula $(WC_{1.04})_p$, wherein p is from 0.01 to 0.99. In some embodiments, a tungsten carbide described herein comprises a tungsten carbide of formula $(WC_{1.05})_p$, wherein p is from 0.01 to 0.99.

In some embodiments, p is from 0.01 to 0.99. In some embodiments, p is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, p is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, p is about 0.01. In some cases, p is about 0.05. In some cases, p is about 0.1. In some cases, p is about 0.15. In some cases, p is about 0.2. In some cases, p is about 0.25. In some cases, p is about 0.3. In some cases, p is about 0.35. In some cases, p is about 0.4. In some cases, p is about 0.5. In some cases, p is about 0.6. In some cases, p is about 0.7. In some cases, p is about 0.75. In some cases, p is about 0.8. In some cases, p is about 0.85. In some cases, p is about 0.9. In some cases, p is about 0.95. In some cases, p is about 0.99. In some cases, p is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, p is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some cases, T is an alloy comprising at least one Group 4, 5, 6, 7, 8, 9, 10, 11, 12, 13, or 14 element in the Periodic Table of Elements. Sometimes, T is an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T comprises Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. In some embodiments, the weight percentage of Cu is at least about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %; alternatively or in combination, the weight percentage of Cu is no more than about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %. The weight percentage of Co may be about 10-20 wt. %. In some embodiments, the weight percentage of Co is at least about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %; alternatively or in combination, the weight percentage of Cu is no more than about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %. The weight percentage of Sn may be less than 7 wt. %, may be up to 7 wt. % or may be about 5 wt. %. In some embodiments, the weight percentage of Sn is at least about 1 wt. %, 2 wt. %, 3 wt. %, 4 wt. %, 5 wt. %, 6 wt. %, or about 7 wt. %; alternatively or in combination, the weight percentage of Sn is no more than about 1 wt. %, 2 wt. %, 3 wt. %, 4 wt. %, 5 wt. %, 6 wt. %, or about 7 wt. %. The weight percentage of Ni may be about 5-15 wt. %. In some embodiments, the weight percentage of Ni is at least about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %; alternatively or in combination, the weight percentage of Ni is no more than about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %. The weight percentage of W may be about 15 wt. %.

In some embodiments, q is from 0.01 to 0.99. In some embodiments, q is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, q is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some instances, q is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, q is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some instances, n is about 0.01, 0.05, 0.1, 0.15, 0.2, 0.25, 0.3, 0.35, 0.4, 0.45 or 0.5. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5. In some instances, n is at least about 0.01, 0.05, 0.1, 0.15, 0.2, 0.25, 0.3, 0.35, 0.4, 0.45 or 0.5; alternatively or in combination, n is no more than about 0.01, 0.05, 0.1, 0.15, 0.2, 0.25, 0.3, 0.35, 0.4, 0.45 or 0.5.

In some cases, as used herein, p, q and n are weight percentage ranges.

In some embodiments, a composite matrix described herein comprising: (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Cu_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Cu_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Ni_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Ni_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Co_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Co_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Fe_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Fe_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Si_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Si_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Al_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Al_q$; wherein q is from 0.01 to 0.99; and wherein the sum of p, q, and n is 1.

In some embodiments, a composite matrix described herein comprising: (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{0.99})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_1)_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.01})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.02})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.03})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.04})_p$, wherein p is from 0.01 to 0.99; and (c) a second formula $Ti_q$; wherein q is from 0.01 to 0.99; and wherein the sum of p, q, and n is 1. In some embodiments, a composite matrix described herein comprising: (a) a tungsten tetraboride of formula $(WB_4)_n$, wherein n is from 0.01 to 0.99; (b) a tungsten carbide of formula $(WC_{1.05})_p$, wherein p is from 0.01 to 0.99; and (c) a second formula $Ti_q$; wherein q is from 0.01 to 0.99; and wherein the sum of p, q, and n is 1.

In some embodiments, described herein is a composite matrix which comprises:

a) a tungsten tetraboride $(WB_4)_n$
wherein:
n is from 0.01 to 0.99;

b) a tungsten carbide of formula $(WC_{0.99\text{-}1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof, wherein:
X' is one of boron (B), beryllium (Be), and silicon (Si);
M' is at least one of Hf, Zr, and Y;
q is from 0.01 to 0.99; and
wherein the sum of p, q, and n is 1; and
wherein the second formula encompasses the edges, in part or in whole, of the composition comprising a) and b), acting as a protective coating.

In some embodiments, X' is B and n and p are as described above. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

Tungsten-Based Composite Matrix Comprising Beryllium

In some embodiments, described herein is a composite matrix which comprises:

a) a first formula $(W_{1-x}M_xBe_y)_n$ wherein:

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $T_q$:

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, M comprises at least one of Re, Ta, Mn, Cr, Hf, Ta, Zr and Y. In some embodiments, M comprises at least one of Re, Ta, Mn and Cr. Sometimes, M comprises at least one of Ta, Mn and Cr. Other times, M comprises at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al). In some cases, M comprises Ta and an element selected from Ti, V, Cr, Mn, Fe, Co, Ni, Cu, Zn, Zr, Nb, Mo, Ru, Hf, Re, Os, Jr, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Jr, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Jr, Li, Y and Al. In some cases, M comprises Y and an element selected from Ti, V, Cr, Mn, Fe, Co, Ni, Cu, Zn, Ta, Nb, Mo, Ru, Hf, Re, Os, Jr, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M is selected from Ta, Mn, Cr, Ta and Mn, or Ta and Cr. M can be Re. Other times, M is selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li.

In some embodiments, x has a value within the range 0.001 to 0.999, inclusively. In some embodiments, x has a value within the range 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some cases, x is at least about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999; alternatively or in combination, x is no more than about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99.

In some embodiments, y is at least 2, 4, 6, or 12. In some instances, y is at least 2. In some cases, y is at least 4. In some cases, y is at least 6. In some cases y is at least 12. In some cases, y is no more than 2, 4, 6, or 12. In some cases, y is no more than 2. In some cases, y is no more than 4. In some cases, y is no more than 6. In some cases, y is no more than 12.

In some instances, n is about 0.01, 0.05, 0.1, 0.15, 0.2, 0.25, 0.3, 0.35, 0.4, 0.45 or 0.5. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5. In some instances, n is at least about 0.01, 0.05, 0.1, 0.15, 0.2, 0.25, 0.3, 0.35, 0.4, 0.45 or 0.5; alternatively or in combination, n is no more than about 0.01, 0.05, 0.1, 0.15, 0.2, 0.25, 0.3, 0.35, 0.4, 0.45 or 0.5.

In some embodiments, the tungsten carbide of formula $(WC_{0.99\text{-}1.05})_p$ comprises $WC_{0.99}$, $WC_1$, $WC_{1.01}$, $WC_{1.02}$, $WC_{1.03}$, $WC_{1.04}$ or $WC_{1.05}$. In some embodiments, a tungsten carbide described herein comprises a tungsten carbide of formula $(WC_{0.99})_p$, wherein p is from 0.01 to 0.99. In some embodiments, a tungsten carbide described herein comprises a tungsten carbide of formula $(WC_1)_p$, wherein p is from 0.01 to 0.99. In some embodiments, a tungsten carbide described herein comprises a tungsten carbide of formula $(WC_{1.01})_p$, wherein p is from 0.01 to 0.99. In some embodiments, a tungsten carbide described herein comprises a tungsten carbide of formula $(WC_{1.02})_p$, wherein p is from 0.01 to 0.99. In some embodiments, a tungsten carbide described herein comprises a tungsten carbide of formula $(WC_{1.03})_p$, wherein p is from 0.01 to 0.99. In some embodiments, a tungsten carbide described herein comprises a tungsten carbide of formula $(WC_{1.04})_p$, wherein p is from 0.01 to 0.99. In some embodiments, a tungsten carbide described herein comprises a tungsten carbide of formula $(WC_{1.05})_p$, wherein p is from 0.01 to 0.99.

In some embodiments, p is from 0.01 to 0.99. In some embodiments, p is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, p is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, p is about 0.01. In some cases, p is about 0.05. In some cases, p is about 0.1. In some cases, p is about 0.15. In some cases, p is about 0.2. In some cases, p is about 0.25. In some cases, p is about 0.3. In some cases, p is about 0.35. In some cases, p is about 0.4. In some cases, p is about 0.5. In some cases, p is about 0.6. In some cases, p is about 0.7. In some cases, p is about 0.75. In some cases, p is about 0.8. In some cases, p is about 0.85. In some cases, p is about 0.9. In some cases, p is about 0.95. In some cases, p is about 0.99. In some cases, p is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, p is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

T from the second formula $T_q$ can be an alloy comprising at least one Group 4, 5, 6, 7, 8, 9, 10, 11, 12, 13, or 14 element in the Periodic Table of Elements. Sometimes, T is an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni.

In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T comprises Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. In some embodiments, the weight percentage of Cu is at least about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %; alternatively or in combination, the weight percentage of Cu is no more than about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %. The weight percentage of Co may be about 10-20 wt. %. In some embodiments, the weight percentage of Co is at least about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %; alternatively or in combination, the weight percentage of Cu is no more than about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %. The weight percentage of Sn may be less than 7 wt. %, may be up to 7 wt. % or may be about 5 wt. %. In some embodiments, the weight percentage of Sn is at least about 1 wt. %, 2 wt. %, 3 wt. %, 4 wt. %, 5 wt. %, 6 wt. %, or about 7 wt. %; alternatively or in combination, the weight percentage of Sn is no more than about 1 wt. %, 2 wt. %, 3 wt. %, 4 wt. %, 5 wt. %, 6 wt. %, or about 7 wt. %. The weight percentage of Ni may be about 5-15 wt. %. In some embodiments, the weight percentage of Ni is at least about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %; alternatively or in combination, the weight percentage of Ni is no more than about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %. The weight percentage of W may be about 15 wt. %.

In some embodiments, q is from 0.01 to 0.99. In some embodiments, q is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, q is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some instances, q is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, q is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some cases, as used herein, p, q and n are weight percentage ranges.

In some embodiments, a composite matrix comprising beryllium is resistant to oxidation. In some embodiments, a composite matrix comprising beryllium has anti-oxidation property. For example, when the composite matrix is coated on the surface of a tool, the composite matrix reduces the rate of oxidation of the tool in comparison to a tool not coated with the composite matrix. In an alternative example, when the composite matrix is coated on the surface of a tool, the composite matrix prevents oxidation of the tool in comparison to a tool not coated with the composite matrix. In some instances, a tungsten carbide of formula $(WC_{0.99\text{-}1.05})_p$ in the composite matrix inhibits the formation of oxidation or reduces the rate of oxidation. In other instances, a tungsten carbide of formula $(WC_{0.99\text{-}1.05})_p$ in combination with $T_q$ in the composite matrix inhibits the formation of oxidation or reduces the rate of oxidation.

In some embodiments, a composite matrix comprising beryllium comprises a solid solution phase. In some embodiments, a composite matrix comprising beryllium forms a solid solution. In some instances, the composite matrix in a solid solution phase comprises a tungsten-based compound of a first formula $(W_{1-x}M_xBe_y)_n$, a tungsten carbide of formula $(WC_{0.99\text{-}1.05})_p$, and $T_q$.

In some embodiments, a composite matrix comprising beryllium has a hardness of about 10 to about 70 GPa. In some instances, a composite matrix comprising beryllium has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite matrix described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite matrix comprising silicon has a hardness of at least about 10 GPa, 15 GPa, 20 GPa, 25 GPa, 30 GPa, 35 GPa, 40 GPa, 45 GPa, 50 GPa, 55 GPa, or about 60 GPa; alternatively or in combination, the composite matrix comprising silicon has a hardness of no more than about 10 GPa, 15 GPa, 20 GPa, 25 GPa, 30 GPa, 35 GPa, 40 GPa, 45 GPa, 50 GPa, 55 GPa, 60 GPa, or about 70 GPa.

In some embodiments, a composite matrix comprising beryllium has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite matrix comprising beryllium has a hardness of about 10 GPa or higher. In some embodiments, a composite matrix comprising beryllium has a hardness of about 15 GPa or higher. In some embodiments, a composite matrix comprising beryllium has a hardness of about 20 GPa or higher. In some embodiments, a composite matrix comprising beryllium has a hardness of about 25 GPa or higher. In some embodiments, a composite matrix comprising beryllium has a hardness of about 30 GPa or higher. In some embodiments, a composite matrix comprising beryllium has a hardness of about 31 GPa or higher. In some embodiments, a composite matrix comprising beryllium has a hardness of about 32 GPa or higher. In some embodiments, a composite matrix comprising beryllium has a hardness of about 33 GPa or higher. In some embodiments, a composite matrix comprising beryllium has a hardness of about 34 GPa or higher. In some embodiments, a composite matrix comprising beryllium has a hardness of about 35 GPa or higher. In some embodiments, a composite matrix comprising beryllium has a hardness of about 36 GPa or higher. In some embodiments, a composite matrix comprising beryllium has a hardness of about 37 GPa or higher. In some embodiments, a composite matrix comprising beryllium has a hardness of about 38 GPa or higher. In some embodiments, a composite matrix comprising beryllium has a hardness of about 39 GPa or higher. In some embodiments, a composite matrix comprising beryllium has a hardness of about 40 GPa or higher. In some embodiments, a composite matrix comprising beryllium has a hardness of about 41 GPa or higher. In some embodiments, a composite matrix comprising beryllium has a hardness of about 42 GPa or higher. In some embodiments, a composite matrix comprising beryllium has a hardness of about 43 GPa or higher. In some embodiments, a composite matrix comprising beryllium has a hardness of about 44 GPa or higher. In some embodiments, a composite matrix comprising beryllium has a hardness of about 45 GPa or higher. In some embodiments, a composite matrix comprising beryllium has a hardness of about 46 GPa or higher. In some embodiments, a composite matrix comprising beryllium has a hardness of about 47 GPa or higher. In some embodiments, a composite matrix comprising beryllium has a hardness of about 48 GPa or higher. In some embodiments, a composite matrix comprising beryllium has a hardness of about 49 GPa or higher. In some embodiments, a composite matrix comprising beryllium has a hardness of about 50 GPa or higher. In some embodiments, a composite matrix comprising beryllium has a hardness of about 51 GPa or higher. In some embodiments, a composite matrix comprising beryllium has a hardness of about 52 GPa or higher.

In some embodiments, a composite matrix comprising beryllium has a hardness of about 53 GPa or higher. In some embodiments, a composite matrix comprising beryllium has a hardness of about 54 GPa or higher. In some embodiments, a composite matrix comprising beryllium has a hardness of about 55 GPa or higher. In some embodiments, a composite matrix comprising beryllium has a hardness of about 56 GPa or higher. In some embodiments, a composite matrix comprising beryllium has a hardness of about 57 GPa or higher. In some embodiments, a composite matrix comprising beryllium has a hardness of about 58 GPa or higher. In some embodiments, a composite matrix comprising beryllium has a hardness of about 59 GPa or higher. In some embodiments, a composite matrix comprising beryllium has a hardness of about 60 GPa or higher.

In some embodiments, a composite matrix comprising beryllium has a bulk modulus of about 330 GPa to about 350 GPa.

In some embodiments, a composite matrix comprising beryllium has a grain size of about 20 μm or less. In some instances, the composite matrix has a grain size of about 15 μm or less, about 12 μm or less, about 10 μm or less, about 8 μm or less, about 5 μm or less, about 2 μm or less or about 1 μm or less. In some cases, the composite matrix has a grain size of about 15 μm or less. In some cases, the composite matrix has a grain size of about 12 μm or less. In some cases, the composite matrix has a grain size of about 10 μm or less. In some cases, the composite matrix has a grain size of about 9 μm or less. In some cases, the composite matrix has a grain size of about 8 μm or less. In some cases, the composite matrix has a grain size of about 7 μm or less. In some cases, the composite matrix has a grain size of about 6 μm or less. In some cases, the composite matrix has a grain size of about 5 μm or less. In some cases, the composite matrix has a grain size of about 4 μm or less. In some cases, the composite matrix has a grain size of about 3 μm or less. In some cases, the composite matrix has a grain size of about 2 μm or less. In some cases, the composite matrix has a grain size of about 1 μm or less.

In some instances, the grain size is an averaged grain size. In some cases, a composite matrix comprising beryllium has an averaged grain size of about 20 μm or less. In some instances, the composite matrix has an averaged grain size of about 15 μm or less, about 12 μm or less, about 10 μm or less, about 8 μm or less, about 5 μm or less, about 2 μm or less or about 1 μm or less. In some cases, the composite matrix has an averaged grain size of about 15 μm or less. In some cases, the composite matrix has an averaged grain size of about 12 μm or less. In some cases, the composite matrix has an averaged grain size of about 10 μm or less. In some cases, the composite matrix has an averaged grain size of about 9 μm or less. In some cases, the composite matrix has an averaged grain size of about 8 μm or less. In some cases, the composite matrix has an averaged grain size of about 7 μm or less. In some cases, the composite matrix has an averaged grain size of about 6 μm or less. In some cases, the composite matrix has an averaged grain size of about 5 μm or less. In some cases, the composite matrix has an averaged grain size of about 4 μm or less. In some cases, the composite matrix has an averaged grain size of about 3 μm or less. In some cases, the composite matrix has an averaged grain size of about 2 μm or less. In some cases, the composite matrix has an averaged grain size of about 1 μm or less.

In some embodiments, a composite matrix comprising beryllium is a densified composite matrix. In some instances, the densified composite matrix comprises a tungsten-based compound of a first formula $(W_{1-x}M_xBe_y)_n$, a tungsten carbide of formula $(WC_{0.99-1.05})_p$, and $T_q$.

In some embodiments, described herein is a composite matrix which comprises:

a) a first formula $(W_{1-x}M_xBe_y)_n$
   wherein:
   M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);
   x is from 0.001 to 0.999;
   y is at least 4.0; and
   n is from 0.01 to 0.99;

b) a tungsten carbide of formula $(WC_{0.99-1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof,
   wherein:
   X' is one of boron (B), beryllium (Be), and silicon (Si);
   M' is at least one of Hf, Zr, and Y;
   q is from 0.01 to 0.99; and
   wherein the sum of p, q, and n is 1; and
   wherein the second formula encompasses the edges, in part or in whole, of the composition comprising a) and b), acting as a protective coating.

In some embodiments, X' is B and M, x, y, n, and p as described above. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, M' is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, M' is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

Tungsten-Based Composite Matrix Comprising Silicon

In some embodiments, described herein is a composite matrix which comprises:

a) a first formula $(W_{1-x}M_xSi_y)_n$ wherein:

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $T_q$:

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In some embodiments, M comprises at least one of Re, Ta, Mn, Cr, Hf, Ta, Zr and Y. In some embodiments, M comprises at least one of Re, Ta, Mn and Cr. Sometimes, M comprises at least one of Ta, Mn and Cr. Other times, M comprises at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al). In some cases, M comprises Ta and an element selected from Ti, V, Cr, Mn, Fe, Co, Ni, Cu, Zn, Zr, Nb, Mo, Ru, Hf, Re, Os, Jr, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Jr, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Jr, Li, Y and Al. In some cases, M comprises Y and an element selected from Ti, V, Cr, Mn, Fe, Co, Ni, Cu, Zn, Ta, Nb, Mo, Ru, Hf, Re, Os, Jr, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M is selected from Ta, Mn, Cr, Ta and Mn, or Ta and Cr. M can be Re. Other times, M is selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li.

In some embodiments, x has a value within the range 0.001 to 0.999, inclusively. In some embodiments, x has a value within the range 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some cases, x is at least about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999; alternatively or in combination, x is no more than about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99.

In some embodiments, y is at least 2, 4, 6, or 12. In some instances, y is at least 2. In some cases, y is at least 4. In some cases, y is at least 6. In some cases y is at least 12. In some cases, y is no more than 2, 4, 6, or 12. In some cases, y is no more than 2. In some cases, y is no more than 4. In some cases, y is no more than 6. In some cases, y is no more than 12.

In some instances, n is about 0.01, 0.05, 0.1, 0.15, 0.2, 0.25, 0.3, 0.35, 0.4, 0.45 or 0.5. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5. In some instances, n is at least about 0.01, 0.05, 0.1, 0.15, 0.2, 0.25, 0.3, 0.35, 0.4, 0.45 or 0.5; alternatively or in combination, n is no more than about 0.01, 0.05, 0.1, 0.15, 0.2, 0.25, 0.3, 0.35, 0.4, 0.45 or 0.5.

In some embodiments, the tungsten carbide of formula $(WC_{0.99\text{-}1.05})_p$ comprises $WC_{0.99}$, $WC_1$, $WC_{1.01}$, $WC_{1.02}$, $WC_{1.03}$, $WC_{1.04}$ or $WC_{1.05}$. In some embodiments, a tungsten carbide described herein comprises a tungsten carbide of formula $(WC_{0.99})_p$, wherein p is from 0.01 to 0.99. In some embodiments, a tungsten carbide described herein comprises a tungsten carbide of formula $(WC_1)_p$, wherein p is from 0.01 to 0.99. In some embodiments, a tungsten carbide described herein comprises a tungsten carbide of formula $(WC_{1.01})_p$, wherein p is from 0.01 to 0.99. In some embodiments, a tungsten carbide described herein comprises a tungsten carbide of formula $(WC_{1.02})_p$, wherein p is from 0.01 to 0.99. In some embodiments, a tungsten carbide described herein comprises a tungsten carbide of formula $(WC_{1.03})_p$, wherein p is from 0.01 to 0.99. In some embodiments, a tungsten carbide described herein comprises a tungsten carbide of formula $(WC_{1.04})_p$, wherein p is from 0.01 to 0.99. In some embodiments, a tungsten carbide described herein comprises a tungsten carbide of formula $(WC_{1.05})_p$, wherein p is from 0.01 to 0.99.

In some embodiments, p is from 0.01 to 0.99. In some embodiments, p is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, p is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, p is about 0.01. In some cases, p is about 0.05. In some cases, p is about 0.1. In some cases, p is about 0.15. In some cases, p is about 0.2. In some cases, p is about 0.25. In some cases, p is about 0.3. In some cases, p is about 0.35. In some cases, p is about 0.4. In some cases, p is about 0.5. In some cases, p is about 0.6. In some cases, p is about 0.7. In some cases, p is about 0.75. In some cases, p is about 0.8. In some cases, p is about 0.85. In some cases, p is about 0.9. In some cases, p is about 0.95. In some cases, p is about 0.99. In some cases, p is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, p is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

T from the second formula $T_q$ can be an alloy comprising at least one Group 4, 5, 6, 7, 8, 9, 10, 11, 12, 13, or 14 element in the Periodic Table of Elements. Sometimes, T is an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T comprises Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. In some embodiments, the weight percentage of Cu is at least about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %; alternatively or in combination, the weight percentage of Cu is no more than about 40 wt. %, 41 wt. %, 42 wt. %, 43 wt. %, 44 wt. %, 45 wt. %, 46 wt. %, 47 wt. %, 48 wt. %, 49 wt. %, 50 wt. %, 51 wt. %, 52 wt. %, 53 wt. %, 54 wt. %, 55 wt. %, 56 wt. %, 57 wt. %, 58 wt. %, 59 wt. %, or about 60 wt. %. The weight percentage of Co may be about 10-20 wt. %. In some embodiments, the weight percentage of Co is at least about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %; alternatively or in combination, the weight percentage of Cu is no more than about 10 wt. %, 11 wt. %, 12 wt. %, 13 wt. %, 14 wt. %, 15 wt. %, 16 wt. %, 17 wt. %, 18 wt. %, 19 wt. %, or about 20 wt. %. The weight percentage of Sn may be less than 7 wt. %, may be up to 7 wt. % or may be about 5 wt. %. In some embodiments, the weight percentage of Sn is at least about 1 wt. %, 2 wt. %, 3 wt. %, 4 wt. %, 5 wt. %, 6 wt. %, or about 7 wt. %; alternatively or in combination, the weight percentage of Sn is no more than about 1 wt. %, 2 wt. %, 3 wt. %, 4 wt. %, 5 wt. %, 6 wt. %, or about 7 wt. %. The weight percentage of Ni may be about 5-15 wt. %. In some embodiments, the weight percentage of Ni is at least about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %; alternatively or in combination, the weight percentage of Ni is no more than about 5 wt. %, 6 wt. %, 7 wt. %; 8 wt. %, 9 wt. %, 10 wt. %, 11 wt. %, 12 wt. %, 13 wt. %, 14 wt. %, or about 15 wt. %. The weight percentage of W may be about 15 wt. %.

In some embodiments, q is from 0.01 to 0.99. In some embodiments, q is from 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75-0.9, 0.75 to 0.8, 0.8 to 0.99, or 0.8-0.9.

In some cases, q is about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some instances, q is at least about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99; alternatively or in combination, q is no more than about 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, or 0.99.

In some cases, as used herein, p, q and n are weight percentage ranges.

In some embodiments, a composite matrix comprising silicon is resistant to oxidation. In some embodiments, a composite matrix comprising silicon has anti-oxidation property. For example, when the composite matrix is coated on the surface of a tool, the composite matrix reduces the rate of oxidation of the tool in comparison to a tool not coated with the composite matrix. In an alternative example, when the composite matrix is coated on the surface of a tool, the composite matrix prevents oxidation of the tool in comparison to a tool not coated with the composite matrix. In some instances, a tungsten carbide of formula $(WC_{0.99-1.05})_p$ in the composite matrix inhibits the formation of oxidation or reduces the rate of oxidation. In other instances, a tungsten carbide of formula $(WC_{0.99-1.05})_p$ in combination with $T_q$ in the composite matrix inhibits the formation of oxidation or reduces the rate of oxidation.

In some embodiments, a composite matrix comprising silicon comprises a solid solution phase. In some embodiments, a composite matrix comprising silicon forms a solid solution. In some instances, the composite matrix in a solid solution phase comprises a tungsten-based compound of a first formula $(W_{1-x}M_xSi_y)_n$, a tungsten carbide of formula $(WC_{0.99-1.05})_p$, and $T_q$.

In some embodiments, a composite matrix comprising silicon has a hardness of about 10 to about 70 GPa. In some instances, a composite matrix comprising silicon has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite matrix described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite matrix comprising silicon has a hardness of at least about 10 GPa, 15 GPa, 20 GPa, 25 GPa, 30 GPa, 35 GPa, 40 GPa, 45 GPa, 50 GPa, 55 GPa, or about 60 GPa; alternatively or in combination, the composite matrix comprising silicon has a hardness of no more than about 10 GPa, 15 GPa, 20 GPa, 25 GPa, 30 GPa, 35 GPa, 40 GPa, 45 GPa, 50 GPa, 55 GPa, 60 GPa, or about 70 GPa.

In some embodiments, a composite matrix comprising silicon has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite matrix comprising silicon has a hardness of about 10 GPa or higher. In some embodiments, a composite matrix comprising silicon has a hardness of about 15 GPa or higher. In some embodiments, a composite matrix comprising silicon has a hardness of about 20 GPa or higher. In some embodiments, a composite matrix comprising silicon has a hardness of about 25 GPa or higher. In some embodiments, a composite matrix comprising silicon has a hardness of about 30 GPa or higher. In some embodiments, a composite matrix comprising silicon has a hardness of about 31 GPa or higher. In some embodiments, a composite matrix comprising silicon has a hardness of about 32 GPa or higher. In some embodiments, a composite matrix comprising silicon has a hardness of about 33 GPa or higher. In some embodiments, a composite matrix comprising silicon has a hardness of about 34 GPa or higher. In some embodiments, a composite matrix comprising silicon has a hardness of about 35 GPa or higher. In some embodiments, a composite matrix comprising silicon has a hardness of about 36 GPa or higher. In some embodiments, a composite matrix comprising silicon has a hardness of about 37 GPa or higher. In some embodiments, a composite matrix comprising silicon has a hardness of about 38 GPa or higher. In some embodiments, a composite matrix comprising silicon has a hardness of about 39 GPa or higher. In some embodiments, a composite matrix comprising silicon has a hardness of about 40 GPa or higher. In some embodiments, a composite matrix comprising silicon has a hardness of about 41 GPa or higher. In some embodiments, a composite matrix comprising silicon has a hardness of about 42 GPa or higher. In some embodiments, a composite matrix comprising silicon has a hardness of about 43 GPa or higher. In some embodiments, a composite matrix comprising silicon has a hardness of about 44 GPa or higher. In some embodiments, a composite matrix comprising silicon has a hardness of about 45 GPa or higher. In some embodiments, a composite matrix comprising silicon has a hardness of about 46 GPa or higher. In some embodiments, a composite matrix comprising silicon has a hardness of about 47 GPa or higher. In some embodiments, a composite matrix comprising silicon has a hardness of about 48 GPa or higher. In some embodiments, a composite matrix comprising silicon has a hardness of about 49 GPa or higher. In some embodiments, a composite matrix comprising silicon has a hardness of about 50 GPa or higher. In some embodiments, a composite matrix comprising silicon has a hardness of about 51 GPa or higher. In some embodiments, a composite matrix comprising silicon has a hardness of about 52 GPa or higher. In some embodiments, a composite matrix comprising silicon has a hardness of about 53 GPa or higher. In some embodiments, a composite matrix comprising silicon has a hardness of about 54 GPa or higher. In some embodiments, a composite matrix comprising silicon has a hardness of about 55 GPa or higher. In some embodiments, a composite matrix comprising silicon has a hardness of about 56 GPa or higher. In some embodiments, a composite matrix comprising silicon has a hardness of about 57 GPa or higher. In some embodiments, a composite matrix comprising silicon has a hardness of about 58 GPa or higher. In some embodiments, a composite matrix comprising silicon has a hardness of about 59 GPa or higher. In some embodiments, a composite matrix comprising silicon has a hardness of about 60 GPa or higher.

In some embodiments, a composite matrix comprising silicon has a bulk modulus of about 330 GPa to about 350 GPa.

In some embodiments, a composite matrix comprising silicon has a grain size of about 20 μm or less. In some instances, the composite matrix has a grain size of about 15 μm or less, about 12 μm or less, about 10 μm or less, about 8 μm or less, about 5 μm or less, about 2 μm or less or about 1 μm or less. In some cases, the composite matrix has a grain size of about 15 μm or less. In some cases, the composite matrix has a grain size of about 12 μm or less. In some cases, the composite matrix has a grain size of about 10 μm or less. In some cases, the composite matrix has a grain size of about 9 μm or less. In some cases, the composite matrix has a grain size of about 8 μm or less. In some cases, the composite matrix has a grain size of about 7 μm or less. In some cases, the composite matrix has a grain size of about 6 μm or less. In some cases, the composite matrix has a grain size of about 5 μm or less. In some cases, the composite matrix has a grain size of about 4 μm or less. In some cases, the composite matrix has a grain size of about 3 μm or less. In some cases, the composite matrix has a grain size of about 2 μm or less. In some cases, the composite matrix has a grain size of about 1 μm or less.

In some instances, the grain size is an averaged grain size. In some cases, a composite matrix comprising silicon has an averaged grain size of about 20 μm or less. In some instances, the composite matrix has an averaged grain size of about 15 μm or less, about 12 μm or less, about 10 μm or less, about 8 μm or less, about 5 μm or less, about 2 μm or less or about 1 μm or less. In some cases, the composite matrix has an averaged grain size of about 15 μm or less. In some cases, the composite matrix has an averaged grain size of about 12 μm or less. In some cases, the composite matrix has an averaged grain size of about 10 μm or less. In some cases, the composite matrix has an averaged grain size of about 9 μm or less. In some cases, the composite matrix has an averaged grain size of about 8 μm or less. In some cases, the composite matrix has an averaged grain size of about 7 μm or less. In some cases, the composite matrix has an averaged grain size of about 6 μm or less. In some cases, the composite matrix has an averaged grain size of about 5 μm or less. In some cases, the composite matrix has an averaged grain size of about 4 μm or less. In some cases, the composite matrix has an averaged grain size of about 3 μm or less. In some cases, the composite matrix has an averaged grain size of about 2 μm or less. In some cases, the composite matrix has an averaged grain size of about 1 μm or less.

In some embodiments, a composite matrix comprising silicon is a densified composite matrix. In some instances, the densified composite matrix comprises a tungsten-based compound of a first formula $(W_{1-x}M_xSi_y)_n$, a tungsten carbide of formula $(WC_{0.99-1.05})_p$, and $T_q$.

In some embodiments, described herein is a composite matrix which comprises:

a) a first formula $(W_{1-x}M_xSi_y)_n$
   wherein:
   M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);
   x is from 0.001 to 0.999;
   y is at least 4.0; and
   n is from 0.01 to 0.99;

b) a tungsten carbide of formula $(WC_{0.99-1.05})_p$, wherein p is from 0.01 to 0.99; and c) a second formula $(M'X')_q$, $(M'X'_2)_q$, $(M'X'_4)_q$, $(M'X'_6)_q$, or $(M'X'_{12})_q$, or a combination thereof,
   wherein:
   X' is one of boron (B), beryllium (Be), and silicon (Si);
   M' is at least one of Hf, Zr, and Y;
   q is from 0.01 to 0.99; and
   wherein the sum of p, q, and n is 1; and
   wherein the second formula encompasses the edges, in part or in whole, of the composition comprising a) and b), acting as a protective coating.

In some embodiments, X' is B and M, x, y, n, and p are as described above. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, M' is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, M' is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

Methods of Manufacture

In certain embodiments, described herein include methods of making a composite matrix. In some embodiments, described herein comprises a method of preparing an oxidative resistant composite matrix, which comprises (a) blending together a first composition having a formula $(W_{1-x}M_xX_y)_n$, a tungsten carbide composition of formula $(WC_{0.99-1.05})_p$, and a second composition of formula $T_q$ for a time sufficient to produce a powder mixture; wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; p, q, and n are each independently from 0.01 to 0.99; and the sum of p, q, and n is 1; (b) pressing the powder mixture under a pressure sufficient to generate a pellet; and (c) sintering the pellet at a temperature sufficient to produce a densified composite matrix.

In some embodiments, described herein comprises a method of preparing a densified composite matrix, which comprises (a) blending together a first composition having a formula $(W_{1-x}M_xB_4)_n$, a tungsten carbide composition of formula $(WC_{0.99-1.05})_p$, and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; p, q, and n are each independently from 0.01 to 0.99; and the sum of p, q, and n is 1; (b) pressing the powder mixture under a pressure sufficient to generate a pellet; and (c) sintering the pellet at a temperature sufficient to produce a densified composite matrix.

In some embodiments, described herein comprises a method of preparing a densified composite matrix, which comprises (a) blending together a first composition having a formula $(WB_4)_n$, a tungsten carbide composition of formula $(WC_{0.99\text{-}1.05})_p$, and a second composition of formula $T_q$ for a time sufficient to produce a powder mixture; wherein: T is an alloy comprising at least one Group 4, 5, 6, 7, 8, 9, 10, 11, 12, 13, or 14 element in the Periodic Table of Elements; p, q, and n are each independently from 0.01 to 0.99; and the sum of p, q, and n is 1; (b) pressing the powder mixture under a pressure sufficient to generate a pellet; and (c) sintering the pellet at a temperature sufficient to produce a densified composite matrix.

In some embodiments, described herein comprises a method of preparing a densified composite matrix, which comprises (a) blending together a first composition having a formula $(W_{1-x}M_xBe_y)_n$, a tungsten carbide composition of formula $(WC_{0.99\text{-}1.05})_p$, and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; p, q, and n are each independently from 0.01 to 0.99; and the sum of p, q, and n is 1; (b) pressing the powder mixture under a pressure sufficient to generate a pellet; and (c) sintering the pellet at a temperature sufficient to produce a densified composite matrix.

In some embodiments, described herein comprises a method of preparing a densified composite matrix, which comprises (a) blending together a first composition having a formula $(W_{1-x}M_xSi_y)_n$, a tungsten carbide composition of formula $(WC_{0.99\text{-}1.05})_p$, and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; p, q, and n are each independently from 0.01 to 0.99; and the sum of p, q, and n is 1; (b) pressing the powder mixture under a pressure sufficient to generate a pellet; and (c) sintering the pellet at a temperature sufficient to produce a densified composite matrix.

In some embodiments, the blending time is about 5 minutes to about 6 hours. In some instances, the blending time is about 5 minutes, about 10 minutes, about 15 minutes, about 20 minutes, about 30 minutes, about 45 minutes, about 1 hour, about 1.5 hour, about 2 hours, about 3 hours, about 4 hours, about 5 hours or about 6 hours.

In some embodiments, the blending time is at least 5 minutes or more. In some cases, the blending time is about 10 minutes or more. In some cases, the blending time is about 20 minutes or more. In some cases, the blending time is about 30 minutes or more. In some cases, the blending time is about 45 minutes or more. In some cases, the blending time is about 1 hour or more. In some cases, the blending time is about 2 hours or more. In some cases, the blending time is about 3 hours or more. In some cases, the blending time is about 4 hours or more. In some cases, the blending time is about 5 hours or more. In some cases, the blending time is about 6 hours or more. In some cases, the blending time is about 8 hours or more. In some cases, the blending time is about 10 hours or more. In some cases, the blending time is about 12 hours or more.

In some instances, a pressure of up to 36,000 psi is utilized to generate a pellet. In some instances, the pressure is up to 34,000 psi. In some instances, the pressure is up to 32,000 psi. In some instances, the pressure is up to 30,000 psi. In some instances, the pressure is up to 28,000 psi. In some instances, the pressure is up to 26,000 psi. In some instances, the pressure is up to 24,000 psi. In some instances, the pressure is up to 22,000 psi. In some instances, the pressure is up to 20,000 psi. In some instances, the pressure is up to 18,000 psi. In some instances, the pressure is up to 16,000 psi. In some instances, the pressure is up to 15,000 psi. In some instances, the pressure is up to 14,000 psi. In some instances, the pressure is up to 10,000 psi.

In some embodiments, a method described herein further comprises a sintering step. In some instances, the sintering step generates a densified composite matrix. In some instances, the sintering step is carried out at elevated temperatures. In some cases, the temperature during sintering is from 1000° C. to 2000° C. In some cases, the temperature during sintering is from 1000° C. to 1900° C. In some cases, the temperature during sintering is from 1200° C. to 1900° C. In some cases, the temperature during sintering is from 1300° C. to 1900° C. In some cases, the temperature during sintering is from 1400° C. to 1900° C. In some cases, the temperature during sintering is from 1000° C. to 1800° C. In some cases, the temperature during sintering is from 1000° C. to 1700° C. In some cases, the temperature during sintering is from 1200° C. to 1800° C. In some cases, the temperature during sintering is from 1300° C. to 1700° C. In some cases, the temperature during sintering is from 1000° C. to 1600° C. In some cases, the temperature during sintering is from 1500° C. to 1800° C. In some cases, the temperature during sintering is from 1500° C. to 1700° C. In some cases, the temperature during sintering is from 1500° C. to 1600° C. In some cases, the temperature during sintering is from 1600° C. to 2000° C. In some cases, the temperature during sintering is from 1600° C. to 1900° C. In some cases, the temperature during sintering is from 1600° C. to 1800° C. In some cases, the temperature during sintering is from 1600° C. to 1700° C. In some cases, the temperature during sintering is from 1700° C. to 2000° C. In some cases, the temperature during sintering is from 1700° C. to 1900° C. In some cases, the temperature during sintering is from 1700° C. to 1800° C. In some cases, the temperature during sintering is from 1800° C. to 2000° C. In some cases, the temperature during sintering is from 1800° C. to 1900° C. In some cases, the temperature during sintering is from 1900° C. to 2000° C.

In some cases, the temperature is about 1000° C., about 1100° C., about 1200° C., about 1300° C., about 1400° C., about 1500° C., about 1600° C., about 1700° C., about 1800° C., about 1900° C. or about 2000° C. In some cases, the temperature is about 1000° C. In some cases, the temperature is about 1100° C. In some cases, the temperature is about 1200° C. In some cases, the temperature is about 1300° C. In some cases, the temperature is about 1400° C. In some cases, the temperature is about 1500° C. In some cases, the temperature is about 1600° C. In some cases, the temperature is about 1700° C. In some cases, the temperature is about 1800° C. In some cases, the temperature is about 1900° C. In some cases, the temperature is about 2000° C.

In some cases, sintering is carried out at room temperature.

In some embodiment, a sintering step described herein involves an elevated temperature and an elevated pressure, e.g., hot pressing. Hot pressing is a process involving a simultaneous application of pressure and high temperature, which can accelerate the rate of densification of a material (e.g., a composite matrix described herein). In some instances, a temperature from 1000° C. to 2000° C. and a pressure of up to 36,000 psi are used during hot pressing.

In other embodiments, a sintering step described herein involves an elevated pressure and room temperature, e.g., cold pressing. In such instances, pressure of up to 36,000 psi is used.

Tools and Abrasive Materials

In some embodiments, a composite matrix described herein is used to make, modify or coat a tool or an abrasive material. In some instances, a composite matrix described herein is coated onto the surface of a tool or an abrasive material. In other instances, the surface of a tool or an abrasive material is modified with a composite matrix described herein. In additional instances, the surface of a tool or abrasive material comprises a composite matrix described herein.

In some embodiments, a tool or abrasive material comprises a cutting tool. In some instances, a tool or abrasive material comprises a tool or a component of a tool for cutting, drilling, etching, engraving, grinding, carving or polishing. In some instances, a tool or abrasive material comprises a metal bond abrasive tool, for example, such as a metal bond abrasive wheel or grinding wheel. In some instances, a tool or abrasive material comprises drilling tools. In some instances, a tool or abrasive material comprises drill bits, inserts or dies. In some cases, a tool or abrasive material comprises tools or components used in downhole tooling. In some cases, a tool or abrasive material comprises an etching tool. In some cases, a tool or abrasive material comprises an engraving tool. In some cases, a tool or abrasive material comprises a grinding tool. In some cases, a tool or abrasive material comprises a carving tool. In some cases, a tool or abrasive material comprises a polishing tool.

In some embodiment, a surface of a tool or abrasive material comprises a composite matrix described herein. In some cases, a surface of a tool or abrasive material comprises a composite matrix which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material comprises a composite matrix which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material comprises a composite matrix which comprises (a) a tungsten tetraboride of formula $(WB_4)_n$, wherein n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material comprises a composite matrix which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material comprises a composite matrix which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, the tool or abrasive material comprises a tool or a component of a tool for cutting, drilling, etching, engraving, grinding, carving or polishing. In some cases, the composite matrix inhibits oxidation from forming on the tool or abrasive material. In other cases, the composite matrix reduces the rate of oxidation formed on the tool or abrasive material relative to a tool or abrasive material that does not contain the composite matrix.

In some embodiment, a surface of a tool or abrasive material is modified with a composite matrix described herein. In some cases, a surface of a tool or abrasive material is modified with a composite matrix which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99\text{-}1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is modified with a composite matrix which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is modified with a composite matrix which comprises (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is modified with a composite matrix which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is modified with a composite matrix which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, the tool or abrasive material comprises a tool or a component of a tool for cutting, drilling, etching, engraving, grinding, carving or polishing. In some cases, the composite matrix inhibits oxidation from forming on the tool or abrasive material. In other cases, the composite matrix reduces the rate of oxidation formed on the tool or abrasive material relative to a tool or abrasive material that does not contain the composite matrix.

In some embodiment, a surface of a tool or abrasive material is coated with a composite matrix described herein. In some cases, a surface of a tool or abrasive material is coated with a composite matrix which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is coated with a composite matrix which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is coated with a composite matrix which comprises (a) a tungsten tetraboride of formula $(WB_4)_n$, wherein n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is coated with a composite matrix which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al); x is from 0.001 to 0.999; y is at least 4.0; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, a surface of a tool or abrasive material is coated with a composite matrix which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.01 to 0.99; (b) a tungsten carbide of formula $(WC_{0.99-1.05})_p$, wherein p is from 0.01 to 0.99; and (c) a second formula $T_q$; wherein: T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1. In some cases, the tool or abrasive material comprises a tool or a component of a tool for cutting, drilling, etching, engraving, grinding, carving or polishing. In some cases, the composite matrix inhibits oxidation from forming on the tool or abrasive material. In other cases, the composite matrix reduces the rate of oxidation formed on the tool or abrasive material relative to a tool or abrasive material that does not contain the composite matrix.

In some embodiments, the composite matrix material comprises 10 wt. % of Co metal as a binder. In some further embodiments, the composite matrix material comprises from about 5 wt. % to about 27 wt. % of a solid solution Co—Ni—Fe binder, comprising from about 40 wt. % to about 90 wt. % Co, from about 4 wt. % to about 36 wt. % Ni, and from about 4 wt. % to about 36 wt. % Fe, and wherein a Ni:Fe ratio is from about 1.5:1 to about 1:1.5, and wherein the solid solution of the binder exhibits substantially no stress and strain induced phase transformations.

Certain Terminologies

Unless defined otherwise, all technical and scientific terms used herein have the same meaning as is commonly understood by one of skill in the art to which the claimed subject matter belongs. It is to be understood that the detailed description are exemplary and explanatory only and are not restrictive of any subject matter claimed. In this application, the use of the singular includes the plural unless specifically stated otherwise. It must be noted that, as used in the specification, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

Group 4 metals of the Periodic Table of Elements (may also refer as group IVB or 4B) include titanium (Ti), zirconium (Zr), and hafnium (Hf).

Group 5 metals of the Periodic Table of Elements (may also refer as group VB or 5B) include vanadium (V), niobium (Nb), and tantalum (Ta).

Group 6 metals of the Periodic Table of Elements (may also refer as group VIB or 6B) include chromium (Cr), molybdenum (Mo), and tungsten (W).

Group 7 metals of the Periodic Table of Elements (may also refer as group VIIB or 7B) include manganese (Mn) and rhenium (Re).

Group 8 metals of the Periodic Table of Elements (may also refer as group VIII or 8) include iron (Fe), ruthenium (Ru), and osmium (Os).

Group 9 metals of the Periodic Table of Elements (may also refer as group VIII or 8) include cobalt (Co), rhodium (Rh), and iridium (Jr).

Group 10 metals of the Periodic Table of Elements (may also refer as group VIII or 8) include nickel (Ni), palladium (Pd), and platinum (Pt).

Group 11 metals of the Periodic Table of Elements (may also refer as group IB or 1B) include copper (Cu), silver (Ag), and gold (Au).

Group 12 metals of the Periodic Table of Elements (may also refer as group IIB or 2B) include zinc (Zn) and cadmium (Cd)

Group 13 metals of the Periodic Table of Elements (may also refer as group IIIA or 3A) include aluminum (Al), gallium (Ga), and indium (In).

Group 14 metals of the Periodic Table of Elements (may also refer as group IVA or 4A) include silicon (Si), germanium (Sn), and tin (Sn).

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

As used herein, ranges and amounts can be expressed as "about" a particular value or range. About also includes the exact amount. Hence "about 5 GPa" means "about 5 GPa" and also "5 GPa." Generally, the term "about" includes an amount that would be expected to be within experimental error, e.g., ±5%, ±10% or ±15%. In some cases, "about" includes ±5%. In other cases, "about" includes ±10%. In additional cases, "about" includes ±15%.

The section headings used herein are for organizational purposes only and are not to be construed as limiting the subject matter described.

EXAMPLES

These examples are provided for illustrative purposes only and not to limit the scope of the claims provided herein.

Materials

Mixed solutions of $W_{1-x}M_xX_y$ were synthesized in 99+% purity (SuperMetalix, Inc., USA) using powders of high-purity: boron, berilium and silicon in 99+% purity from Strem Chemicals, U.S.A.; tungsten in 99.99% purity from JMC Puratronic, U.S.A.; titanium, vanadium, chromium, manganese, iron, cobalt, nickel, copper, zinc, zirconium, niobium, molybdenum, ruthenium, hafnium, tantalum, rhenium, osmium, iridium, lithium, yttrium and aluminum in 99+% purity from either Strem Chemicals, U.S.A., Sigma-Aldrich, U.S.A. or JMC Puratronic, U.S.A. Starting materials were mixed and pressed into a 350 mg pellet by means of a hydraulic (Carver) press under 10,000 lbs of force. The pellets were then placed in an arc melting furnace and an AC current of >70 Amps was applied under high-purity argon at ambient pressure.

Tungsten carbide solutions of over 99+% purity were purchased from Fritsch GmbH, Germany. Binder alloys, such as the Co/Ni/Fe alloy used in compound 7 of Table 1 below, were synthesized by Fritsch GmbH with the addition of no more that 2% paraffin wax. The paraffin wax was added to a mixture of the metals as a solution in heptane, and the entire mixture was milled in a planetary ball mill at low speed. The powder was then loaded into a graphite die and prepared for sintering in a spark plasma sinterer (SPS) (Thermal Technologies, USA). The composite was heated at ~50° C./min to 1150° C. and held for 3 minutes, then allowed to cool. The composite was pressed and held at 50 MPa for the duration of the synthesis.

Methods of Characterization

The hardness of each sample was determined using a MicroMet 2103 Vickers microhardness tester (Buehler Ltd, U.S.A.). Fifteen indents of the following force loading were made in random areas of the sample: 0.49, 0.98, 1.96, 2.94 and 4.9N (low to high, respectively). The length of the diagonals were measured using a high resolution optical microscope (Zeiss Axiotech 100 HD, Carl Zeiss Vision GmbH, Germany) with 500× magnification, and Vickers hardness was calculated using Equation 1:

$$H_v = 1854.4F/a^2 \quad (1)$$

where F is the loading force applied in Newton (N) and a is the average of the length of the two diagonals of each indent in micrometers.

Fracture Toughness was determined using the Palmqvist method utilizing a Vickers microindentor with measurements of the crack length to determine the $K_{1C}$ of the material, such as seen in ASTM C1421-18, ASTM STP366305, and ASTM STP366285. The crack length of the indentation must fall within the Palmqvist regime to qualify for this determination methodology for this composite material.

Transverse Rupture Strength is determined using a 3-point bend test, as described in B406-96(2015). This methodology is analogous to ISO 3327.

Example 1. Synthesis of Illustrative Composite Matrix Materials

Table 1 shows the compositions of illustrative composite matrix material.

| Compound No. | $(W_{1-x}M_xX_y)_n$ | wt % | $(WC_{0.99-1.05})_p$ | wt % | $T_q$ | wt % |
|---|---|---|---|---|---|---|
| 1 | $WB_4$ | 25 | $WC_{0.99-1.05}$ | 52.5 | Co | 22.5 |
| 2 | $WB_4$ | 25 | $WC_{0.99-1.05}$ | 67.5 | Ni | 7.5 |
| 3 | $WB_4$ | 25 | $WC_{0.99-1.05}$ | 15 | Fe | 60 |
| 4 | $W_{0.93}Ta_{0.02}Cr_{0.05}B_4$ | 20 | $WC_{0.99-1.05}$ | 24 | Cu | 56 |
| 5 | $W_{0.93}Ta_{0.02}Cr_{0.05}B_4$ | 30 | $WC_{0.99-1.05}$ | 55 | Ti | 14 |
| 6 | $W_{0.93}Ta_{0.02}Cr_{0.05}B_4$ | 40 | $WC_{0.99-1.05}$ | 48 | Al | 12 |
| 7 | $WB_4$ | 45 | $WC_{0.99-1.05}$ | 30 | Co Ni Fe* | 25 |
| 8 | $WB_4$ | 28 | $WC_{0.99-1.05}$ | 15 | Cu W Co Sn Ni** | 57 |

*70 wt. % Co, 15 wt. % Ni, 15 wt. % Fe

**50 wt. % Cu, 15 wt. % W, 20 wt. % Co, 5 wt. % Sn, 10 wt. % Ni

The following protocols can be applied to each of the composite matrices listed above.

Preparations of Composite Matrices

The tungsten-based metal composition, tungsten carbide, and binding metal or alloy (T) are mixed until a uniform mixture is achieved. Mixing is performed via tumbling or low-speed milling. Prior to mixing, a solution of paraffin wax or polyethylene glycol is optionally added in no more that 2% by mass. The solvent is an organic solvent of low to moderate polarity, preferably isopropanol or heptane. The mixture is compacted to generate a pellet. If sintering via cold-press, the pellet is pressed into a green body for vacuum and/or isostatic pressing. If sintering with heat, the pellet is placed in a die of a desired geometry for hot-pressing, plasma spark sintering, electric current assisted (arc) sintering, or microwave sintering.

Preparation of Composite Matrix 7

The tungsten-based metal composition, tungsten carbide, and Co/Ni/Fe were mixed using an agate mortar and pestle until a uniform mixture is achieved. The powder mixture was then subjected to pressure of up to 32,000 psi to generate a pellet. The pellet was subjected to a sintering step to generate the composite matrix. During sintering, the temperature was raised at a rate of about 45° C./min to 2000° C. and held constant for about 3 minutes. Then, the temperature was lowered within 5 minutes to below 1000° C. The pellet was then allowed to cool. The composite matrix was characterized with measurements of Vickers hardness (HV30) and fracture toughness. Vickers hardness measurements of composite matrix 7 yielded values ranging between 13.7-15.7 GPa under a force of 294N (HV30). Fracture toughness measurements yielded a value of 14 MPa $m^{1/2}$.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

Additional Embodiments of the Disclosure

In embodiment 1, is A composite matrix comprising:

a) a first formula $(W_{1-x}M_xX_y)_n$ wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Jr), lithium (Li), yttrium (Y) and aluminum (Al);

x is from 0.001 to 0.999;

y is at least 4.0; and n is from 0.01 to 0.99;

b) a tungsten carbide of formula $(WC_{0.99-1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In embodiment 2, is the composite matrix of embodiment 1, wherein X is B.

In embodiment 3, is the composite matrix of embodiment 1 or 2, wherein M is one of Re, Ta, Mn, Cr, Ta and Mn, or Ta and Cr.

In embodiment 4, is the composite matrix of embodiment 1 or 2, wherein M is one of Ta, Mn, Cr, Ta and Mn, or Ta and Cr.

In embodiment 5, is the composite matrix of embodiment 1, wherein y is 4.

In embodiment 6, is the composite matrix of embodiment 1, wherein x is 0.001 to 0.6.

In embodiment 7, is the composite matrix of embodiment 1, wherein x is 0.001 to 0.4.

In embodiment 8, is the composite matrix of embodiment 1, wherein X is B, M is Re, and x is at least 0.001 and less than 0.05.

In embodiment 9, is the composite matrix of embodiment 8, wherein x is about 0.01.

In embodiment 10, is the composite matrix of embodiment 1, wherein X is B, M is Ta, and x is at least 0.001 and less than 0.05.

In embodiment 11, is the composite matrix of embodiment 10, wherein x is about 0.02.

In embodiment 12, is the composite matrix of embodiment 1, wherein X is B, M is Mn, and x is at least 0.001 and less than 0.4.

In embodiment 13, is the composite matrix of embodiment 1, wherein X is B, M is Cr, and x is at least 0.001 and less than 0.6.

In embodiment 14, is the composite matrix of any one of the embodiments 1-13, wherein T is an alloy comprising at least one Group 8, 9, 10, 11, 12, 13 or 14 element in the Periodic Table of Elements.

In embodiment 15, is the composite matrix of any one of the embodiments 1-13, wherein T is an alloy comprising two or more, three or more, four or more, five or more, or six or more Group 4, 5, 6, 7, 8, 9, 10, 11, 12, 13, or 14 elements in the Periodic Table of Elements.

In embodiment 16, is the composite matrix of any one of the embodiments 1-13, wherein T is an alloy comprising at least one element selected from Cu, Ni, Co, Fe, Si, Al and Ti.

In embodiment 17, is the composite matrix of any one of the embodiments 1-13, wherein T is an alloy comprising at least one element selected from Co, Fe and Ni.

In embodiment 18, is the composite matrix of any one of the embodiments 1-13, wherein T is an alloy comprising Co.

In embodiment 19, is the composite matrix of any one of the embodiments 1-13, wherein T is an alloy comprising Fe.

In embodiment 20, is the composite matrix of any one of the embodiments 1-13, wherein T is an alloy comprising Ni.

In embodiment 21, is the composite matrix of any one of the embodiments 1-20, wherein p is from 0.7 to 0.9.

In embodiment 22, is the composite matrix of any one of the embodiments 1-20, wherein p is about 0.7, 0.75, 0.8, 0.85, 0.9 or 0.95.

In embodiment 23, is the composite matrix of any one of the embodiments 1-20, wherein p is from 0.2 to 0.3.

In embodiment 24, is the composite matrix of any one of the embodiments 1-23, wherein q is from 0.01 to 0.4.

In embodiment 25, is the composite matrix of any one of the embodiments 1-23, wherein q is from 0.1 to 0.3.

In embodiment 26, is the composite matrix of any one of the embodiments 1-23, wherein q is about 0.1, 0.15, 0.2, 0.25, 0.3, 0.35 or 0.4.

In embodiment 27, is the composite matrix of any one of the embodiments 1-23, wherein q is from 0.7 to 0.8.

In embodiment 28, is the composite matrix of any one of the embodiments 1-27, wherein n is from 0.01 to 0.5.

In embodiment 29, is the composite matrix of any one of the embodiments 1-27, wherein n is about 0.1, 0.15, 0.2, 0.25, 0.3, 0.35, 0.4, 0.45 or 0.5.

In embodiment 30, is the composite matrix of any one of the embodiments 1-27, wherein n is about 0.25.

In embodiment 31, is the composite matrix of any one of the embodiments 1-30, wherein p, q and n are weight percentage ranges.

In embodiment 32, is the composite matrix of any one of the embodiments 1-31, wherein the composite matrix forms a solid solution.

In embodiment 33, is the composite matrix of any one of the embodiments 1-32, wherein the composite matrix is resistant to oxidation.

In embodiment 34, is the composite matrix of any one of the embodiments 1-33, wherein the composite matrix is a densified composite matrix.

In embodiment 35, is a composite matrix comprising:

a) a tungsten tetraboride of formula $(WB_4)_n$, wherein n is from 0.01 to 0.99;

b) a tungsten carbide of formula $(WC_{0.99\text{-}1.05})_p$, wherein p is from 0.01 to 0.99; and c) a second formula $T_q$;

wherein:

T is an alloy comprising at least one Group 4, 5, 6, 7, 8, 9, 10, 11, 12, 13, or 14 element in the Periodic Table of Elements; and q is from 0.01 to 0.99; and wherein the sum of p, q, and n is 1.

In embodiment 36, is the composite matrix of embodiment 35, wherein T is an alloy comprising at least one Group 8, 9, 10, 11, 12, 13 or 14 element in the Periodic Table of Elements.

In embodiment 37, is the composite matrix of embodiment 35, wherein T is an alloy comprising two or more, three or more, four or more, five or more, or six or more Group 4, 5, 6, 7, 8, 9, 10, 11, 12, 13, or 14 elements in the Periodic Table of Elements.

In embodiment 38, is the composite matrix of embodiment 35, wherein T is an alloy comprising at least one element selected from Cu, Ni, Co, Fe, Si, Al and Ti.

In embodiment 39, is the composite matrix of embodiment 35, wherein T is an alloy comprising at least one element selected from Co, Fe or Ni.

In embodiment 40, is the composite matrix of embodiment 35, wherein T is an alloy comprising Co.

In embodiment 41, is the composite matrix of embodiment 35, wherein T is an alloy comprising Fe.

In embodiment 42, is the composite matrix of embodiment 35, wherein T is an alloy comprising Ni.

In embodiment 43, is the composite matrix of any one of the embodiments 35-42, wherein p is from 0.7 to 0.9.

In embodiment 44, is the composite matrix of any one of the embodiments 35-42, wherein p is about 0.7, 0.75, 0.8, 0.85, 0.9 or 0.95.

In embodiment 45, is the composite matrix of any one of the embodiments 35-42, wherein p is from 0.2 to 0.3.

In embodiment 46, is the composite matrix of any one of the embodiments 35-45, wherein q is from 0.01 to 0.4.

In embodiment 47, is the composite matrix of any one of the embodiments 35-45, wherein q is from 0.1 to 0.3.

In embodiment 48, is the composite matrix of any one of the embodiments 35-45, wherein q is about 0.1, 0.15, 0.2, 0.25, 0.3, 0.35 or 0.4.

In embodiment 49, is the composite matrix of any one of the embodiments 35-45, wherein q is from 0.7 to 0.8.

In embodiment 50, is the composite matrix of any one of the embodiments 35-49, wherein n is from 0.01 to 0.5.

In embodiment 51, is the composite matrix of any one of the embodiments 35-49, wherein n is about 0.1, 0.15, 0.2, 0.25, 0.3, 0.35, 0.4, 0.45 or 0.5.

In embodiment 52, is the composite matrix of any one of the embodiments 35-49, wherein n is about 0.25.

In embodiment 53, is the composite matrix of any one of the embodiments 35-52, wherein p, q and n are weight percentage ranges.

In embodiment 54, is a method of preparing a densified composite matrix, comprising:

a) blending together a first composition having a formula $(W_{1-x}M_xX_y)_n$, a tungsten carbide composition of formula $(WC_{0.99-1.05})_p$, and a second composition of formula $T_q$ for a time sufficient to produce a powder mixture;

wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

T is an alloy comprising at least one Group 4, 5, 6, 7, 8, 9, 10, 11, 12, 13, or 14 element in the Periodic Table of Elements;

x is from 0.001 to 0.999;

y is at least 4.0;

p, q, and n are each independently from 0.01 to 0.99; and the sum of p, q, and n is 1;

b) pressing the powder mixture under a pressure sufficient to generate a pellet; and c) sintering the pellet at a temperature sufficient to produce a densified composite matrix.

In embodiment 55, is the method of embodiment 54, wherein the pressure is up to 36,000 psi.

In embodiment 56, is the method of embodiment 54, wherein the temperature is from 1000° C. to 2000° C.

In embodiment 57, is the method of embodiment 54, wherein X is B.

In embodiment 58, is the method of embodiment 54 or 57, wherein M is one of Re, Ta, Mn, Cr, Ta and Mn, or Ta and Cr.

In embodiment 59, is the method of embodiment 54 or 57, wherein M is one of Ta, Mn, Cr, Ta and Mn, or Ta and Cr.

In embodiment 60, is the method of embodiment 54, wherein y is 4.

In embodiment 61, is the method of any one of the embodiments 54-60, wherein x is 0.001 to 0.6.

In embodiment 62, is the method of any one of the embodiments 54-60, wherein x is 0.001 to 0.4.

In embodiment 63, is the method of embodiment 54, wherein X is B, M is Re, and x is at least 0.001 and less than 0.05.

In embodiment 64, is the method of embodiment 63, wherein x is about 0.01.

In embodiment 65, is the method of embodiment 54, wherein X is B, M is Ta, and x is at least 0.001 and less than 0.05.

In embodiment 66, is the method of embodiment 65, wherein x is about 0.02.

In embodiment 67, is the method of embodiment 54, wherein X is B, M is Mn, and x is at least 0.001 and less than 0.4.

In embodiment 68, is the method of embodiment 54, wherein X is B, M is Cr, and x is at least 0.001 and less than 0.6.

In embodiment 69, is the method of any one of the embodiments 54-68, wherein T is an alloy comprising at least one Group 8, 9, 10, 11, 12, 13 or 14 element in the Periodic Table of Elements.

In embodiment 70, is the method of any one of the embodiments 54-68, wherein T is an alloy comprising at least one Group 8, 9, 10, 11, 12, 13 or 14 element in the Periodic Table of Elements.

In embodiment 71, is the method of any one of the embodiments 54-68, wherein T is an alloy comprising at least one element selected from Cu, Ni, Co, Fe, Si, Al and Ti.

In embodiment 72, is the method of any one of the embodiments 54-68, wherein T is an alloy comprising at least one element selected from Co, Fe and Ni.

In embodiment 73, is the method of any one of the embodiments 54-68, wherein T is an alloy comprising Co.

In embodiment 74, is the method of any one of the embodiments 54-68, wherein T is an alloy comprising Fe.

In embodiment 75, is the method of any one of the embodiments 54-68, wherein T is an alloy comprising Ni.

In embodiment 76, is the method of any one of the embodiments 54-75, wherein p is from 0.7 to 0.9.

In embodiment 77, is the method of any one of the embodiments 54-75, wherein p is about 0.7, 0.75, 0.8, 0.85, 0.9 or 0.95.

In embodiment 78, is the method of any one of the embodiments 54-75, wherein p is from 0.2 to 0.3.

In embodiment 79, is the method of any one of the embodiments 54-78, wherein q is from 0.01 to 0.4.

In embodiment 80, is the method of any one of the embodiments 54-78, wherein q is from 0.1 to 0.3.

In embodiment 81, is the method of any one of the embodiments 54-78, wherein q is about 0.1, 0.15, 0.2, 0.25, 0.3, 0.35 or 0.4.

In embodiment 82, is the method of any one of the embodiments 54-78, wherein q is from 0.7 to 0.8.

In embodiment 83, is the method of any one of the embodiments 54-82, wherein n is from 0.01 to 0.5.

In embodiment 84, is the method of any one of the embodiments 54-82, wherein n is about 0.1, 0.15, 0.2, 0.25, 0.3, 0.35, 0.4, 0.45 or 0.5.

In embodiment 85, is the method of any one of the embodiments 54-82, wherein n is about 0.25.

In embodiment 86, is the method of any one of the embodiments 54-85, wherein p, q and n are weight percentage ranges.

In embodiment 87, is a tool comprising a surface or body for cutting or abrading, wherein the surface or body comprises a composite matrix of embodiments 1-53.

What is claimed is:

1. A method of preparing a composite matrix, comprising:

a) blending together a first composition having a formula $(W_{1-x}M_xX_y)_n$, a tungsten carbide composition of formula $(WC_{0.99-1.05})_p$, and a second composition of formula $T_q$ for a time sufficient to produce a powder mixture;

wherein:

X is one of B, Be and Si;

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al);

T is an alloy comprising at least one Group 4, 5, 6, 7, 8, 9, 10, 11, 12, 13, or 14 element in a Periodic Table of Elements;

x is from 0 to 0.999;

y is at least 4.0;

p, q, and n are each independently from 0.01 to 0.99; p, q, and n have a sum of 1; and wherein p, q and n are weight percentage ranges;

b) pressing the powder mixture under a pressure sufficient to generate a pellet; and c) sintering the pellet at a temperature sufficient to produce a densified composite matrix;

wherein the composite matrix has a fracture toughness of at least about 1 to 25 MPa $m^{1/2}$ as determined using the Palmquist method; and wherein the composite matrix has a hardness of at least about 1 to 40 GPa as determined by Vickers hardness under a force of 294N (HV30).

2. The method of claim 1, wherein the pressure is up to 36,000 psi.

3. The method of claim 1, wherein the pressure is from 10,000 to 36,000 psi.

4. The method of claim 1, wherein the temperature is from 1000° C. to 2000° C.

5. The method of claim 1, wherein the temperature is from 1500° C. to 2000° C.

6. The method of claim 1, wherein the blending time is about 5 minutes or more.

7. The method of claim 1, wherein composite matrix is formed by cold-press.

8. The method of claim 1, wherein composite matrix is formed by hot-pressing, plasma spark sintering, electric current assisted (arc) sintering, or microwave sintering.

9. The method of claim 1, wherein composite matrix is formed by plasma spark sintering.

10. The method of claim 1, wherein X is B.

11. The method of claim 1, wherein y is 4.

12. The method of claim 1, wherein M is one of Re, Ta, Mn, Cr, Ta and Mn, or Ta and Cr.

13. The method of claim 1, wherein x is 0.001 to 0.4.

14. The method of claim 1, wherein T is an alloy comprising at least one element selected from Cu, Ni, Co, Fe, Si, Al and Ti.

15. The method of claim 1, wherein p is from 0.01 to 0.85.

16. The method of claim 1, wherein p is from 0.01 to 0.4.

17. The method of claim 1, wherein q is from 0.01 to 0.5.

18. The method of claim 1, wherein q is from 0.01 to 0.2.

19. The method of claim 1, wherein n is from 0.01 to 0.9.

20. The method of claim 1, wherein n is from 0.3 to 0.6.

* * * * *